US010513128B2

(12) United States Patent
Tamai et al.

(10) Patent No.: US 10,513,128 B2
(45) Date of Patent: Dec. 24, 2019

(54) DECURLING DEVICE AND INKJET RECORDING APPARATUS

(71) Applicant: KYOCERA Document Solutions Inc., Osaka (JP)

(72) Inventors: Hiroatsu Tamai, Osaka (JP); Takeshi Watanabe, Osaka (JP); Hiroyuki Ueda, Osaka (JP); Noriaki Ozawa, Osaka (JP); Toyotsune Inoue, Osaka (JP); Susumu Hiroshima, Osaka (JP); Takatoshi Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/112,884

(22) Filed: Aug. 27, 2018

(65) Prior Publication Data

US 2019/0061381 A1 Feb. 28, 2019

(30) Foreign Application Priority Data

Aug. 28, 2017 (JP) ..... 2017-163289

(51) Int. Cl.
*B41J 11/00* (2006.01)
*B41J 2/01* (2006.01)

(52) U.S. Cl.
CPC ..... *B41J 11/0005* (2013.01); *B41J 11/002* (2013.01); *B41J 2/01* (2013.01)

(58) Field of Classification Search
CPC ..... B41J 11/0005; B41J 11/002; B41J 2/01
See application file for complete search history.

(56) References Cited

U.S. PATENT DOCUMENTS 6,092,891 A * 7/2000 Okubo ..... B41J 11/002 101/487
2003/0137572 A1* 7/2003 Miyamoto ..... B41J 11/0005 347/102
2004/0189773 A1* 9/2004 Masumi ..... B41J 11/002 347/102
2008/0253797 A1* 10/2008 Sakagami ..... B41J 2/1714 399/92
2010/0231673 A1 9/2010 Chiwata

FOREIGN PATENT DOCUMENTS

JP 2010-208299 A 9/2010

* cited by examiner

*Primary Examiner* — Yaovi M Ameh
(74) *Attorney, Agent, or Firm* — Studebaker & Brackett PC

(57) ABSTRACT

A decurling device includes a belt, a roller, and a heat source. The heat source heats either or both of the belt and the roller. The belt has a first holding surface extending in a rotational direction of the belt. The roller has a second holding surface extending in a rotational direction of the roller. The decurling device has either or both of a plurality of belt through holes penetrating the first holding surface and a plurality of through holes penetrating the second holding surface.

12 Claims, 15 Drawing Sheets

DECURLING DEVICE AND INKJET RECORDING APPARATUS

INCORPORATION BY REFERENCE

The present application claims priority under 35 U.S.C. § 119 to Japanese Patent Application No. 2017-163289, filed on Aug. 28, 2017. The contents of this application are incorporated herein by reference in their entirety.

BACKGROUND

The present disclosure relates to a decurling device and an inkjet recording apparatus.

An inkjet recording apparatus that forms an image on a recording medium is known. The inkjet recording apparatus includes a pressure drum, an inkjet head, and an ink drying unit. The pressure drum is a large drum. The pressure drum conveys the recording medium. Specifically, the recording medium is attached to an outer circumferential surface of the pressure drum. Thus, the recording medium is conveyed when the pressure drum rotates. The inkjet head ejects ink on to the recording medium conveyed by the pressure drum and forms an image on the recording medium. The ink drying unit blows hot air on to the recording medium conveyed by the pressure drum and accelerates drying of moisture in the ink attached to the recording medium.

SUMMARY

A decurling device according to an aspect of the present disclosure receives a sheet conveyed thereto. The decurling device includes a first belt, a rotating member, and a heat source. The first belt is rotatably supported. The rotating member is rotatably supported. The heat source heats either or both of the first belt and the rotating member. The first belt has a first holding surface extending in a rotational direction of the first belt. The rotating member has a second holding surface extending in a rotational direction of the rotating member. The first belt and the rotating member rotate while holding the sheet between the first holding surface and the second holding surface to convey the sheet. The decurling device has either or both of a plurality of first through holes penetrating the first holding surface and a plurality of second through holes penetrating the second holding surface.

An inkjet recording apparatus according to another aspect of the present disclosure includes the above decurling device.

An inkjet recording apparatus according to another aspect of the present disclosure includes the above decurling device, a casing, and a first pipe. The casing houses the decurling device. The first pipe connects to a first outlet and to an exterior of the casing.

An inkjet recording apparatus according to another aspect of the present disclosure includes the above decurling device, a casing, and a second pipe. The casing houses the decurling device. The second pipe connects to a second outlet and to an exterior of the casing.

DETAILED DESCRIPTION

Figure 1:
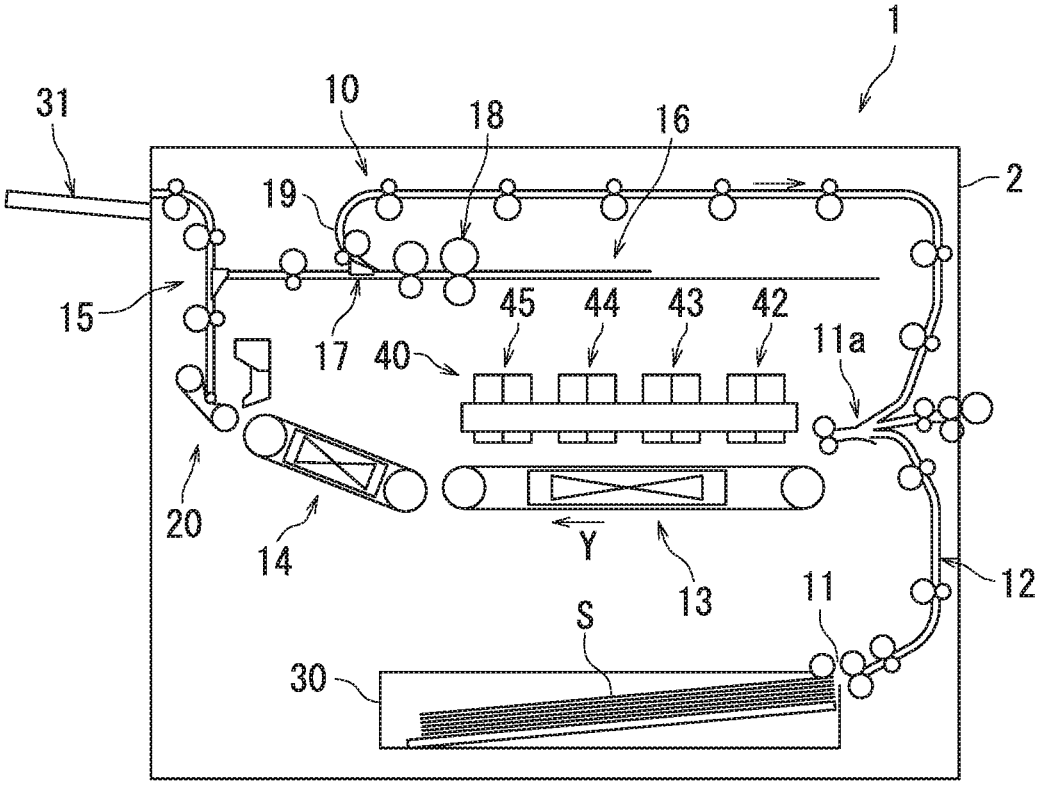
FIG. 1 is a schematic cross-sectional view of an inkjet recording apparatus according to a first embodiment of the present disclosure.

Embodiments of the present disclosure will be described with reference to the drawings. Note that elements in the drawings that are the same or equivalent are labelled using the same reference signs and description thereof will not be repeated.

First Embodiment

An inkjet recording apparatus 1 according to a first embodiment of the present disclosure will be described with reference to FIG. 1. FIG. 1 is a schematic cross-sectional view of the inkjet recording apparatus 1.

As illustrated in FIG. 1, the inkjet recording apparatus 1 includes a casing 2, a conveyor device 10, a decurling device 20, a cassette 30, an exit tray 31, and an image forming section 40.

The casing 2 houses the conveyor device 10, the decurling device 20, the cassette 30, and the image forming section 40.

The conveyor device 10 includes a feeding section 11, a sheet guiding section 12, a first belt conveyance section 13, a second belt conveyance section 14, a first guiding section 15, a reverse guiding section 16, a diverging section 17, a reversing section 18, and a second guiding section 19.

The cassette 30 houses a sheet S. The feeding section 11 sends the sheet S out of the cassette 30 to the sheet guiding section 12. Examples of the sheet S include plain paper, thick paper, overhead projector (OHP) transparency, an envelope, a postcard, and an invoice form.

The sheet guiding section 12 guides the sheet S sent from the cassette 30 to the image forming section 40. The first belt conveyance section 13 faces the image forming section 40. The first belt conveyance section 13 conveys the sheet S sent from the sheet guiding section 12 with the sheet S facing toward the image forming section 40.

The image forming section 40 ejects ink. Specifically, the image forming section 40 has a plurality of heads, and ejects the ink from each head. The image forming section 40 ejects the ink on to the sheet S conveyed by the first belt conveyance section 13. The image forming section 40 ejects the ink on to the sheet S to form an image on the sheet S. Colors of the ink include black, cyan, magenta, and yellow, for example. The ink is water-based, for example.

The second belt conveyance section 14 conveys the sheet S that has passed the image forming section 40 toward the decurling device 20. The decurling device 20 conveys the sheet S toward the first guiding section 15. The first guiding section 15 guides the sheet S sent from the decurling device 20 to the exit tray 31. As a result, the sheet S is ejected to the exit tray 31.

The reverse guiding section 16 diverges from the first guiding section 15. The diverging section 17 is provided in the reverse guiding section 16. The diverging section 17 guides the sheet S sent from the first guiding section 15 to the reverse guiding section 16 toward the reversing section 18.

The reversing section 18 is provided in the reverse guiding section 16. The reversing section 18 reverses an advancing direction of the sheet S sent from the diverging section 17 and returns the sheet S to the diverging section 17. The diverging section 17 guides the sheet S sent from the reversing section 18 to the second guiding section 19. The second guiding section 19 guides the sheet S to a return position 11*a*. Accordingly, the sheet S that has passed the image forming section 40 is guided to the return position 11*a* through the second guiding section 19. The return position 11*a* is provided in the sheet guiding section 12. The return position 11*a* is farther upstream in a conveyance direction Y of the sheet S than the image forming section 40. The conveyance direction Y of the sheet S indicates a moving direction of the sheet S when the image forming section 40 forms an image on the sheet S.

Obverse and reverse surfaces of the sheet S guided by the second guiding section 19 to the return position 11*a* are inverted. That is, the obverse and reverse surfaces of the sheet S are inverted after an image is formed on the obverse surface. Thus, the sheet S is guided to the return position 11*a*. The sheet S is then conveyed to the image forming section 40. The image forming section 40 then forms an image on the reverse surface of the sheet S. Accordingly, the sheet S is returned to the image forming section 40 by the second guiding section 19 after obverse side printing is performed on the sheet S. Reverse side printing is then performed on the sheet S. As a result, double-sided printing is completed on the sheet S.

Figure 2:
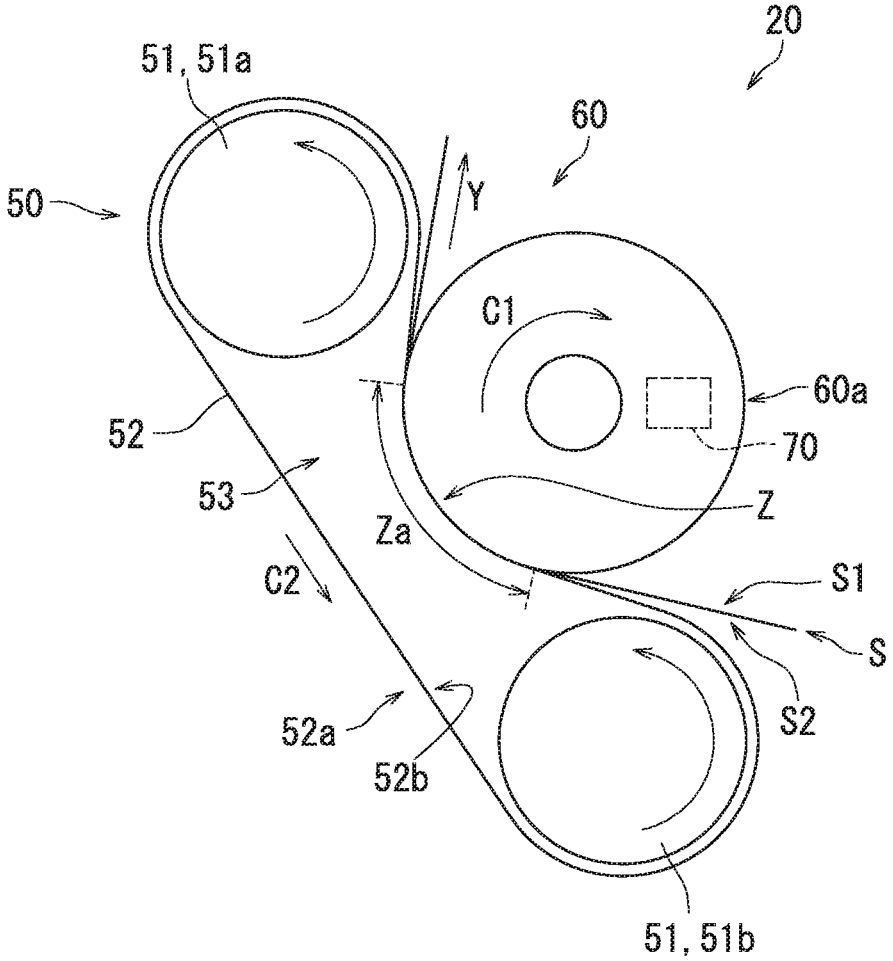
FIG. 2 is a diagram illustrating a decurling device of the first embodiment.

Next, the decurling device 20 will be described with reference to FIG. 2. FIG. 2 is a diagram illustrating the decurling device 20 of the first embodiment.

As illustrated in FIG. 2, the decurling device 20 conveys the sheet S while bending the sheet S. The decurling device 20 is disposed downstream of the image forming section 40 in the conveyance direction Y of the sheet S. The sheet S is conveyed to the decurling device 20. In detail, the sheet S that has passed the image forming section 40 is conveyed to the decurling device 20. The decurling device 20 has a belt member 50, a roller (rotating member) 60, and a heat source 70.

The belt member 50 has a plurality of support rollers 51 and a belt (first belt) 52. The support rollers 51 include a first support roller 51*a* and a second support roller 51*b*. The first support roller 51*a* and the second support roller 51*b* are each rotatably supported. The first support roller 51*a* and the second support roller 51*b* are arranged with a space therebetween. The belt 52 is endless. The belt 52 is wound around the support rollers 51. Specifically, the belt 52 is wound around the first support roller 51*a* and the second support roller 51*b*. The belt 52 is rotatably supported. The belt 52 rotates together with the first support roller 51*a* and the second support roller 51*b*.

The belt 52 has a first holding surface 52*a*. The first holding surface 52*a* extends in a rotational direction of the belt 52. The first holding surface 52*a* is loop-shaped in the rotational direction of the belt 52. The first holding surface 52*a* is on the outside of the belt 52. A first hollow space 53 is located inside of the first holding surface 52*a*. The first hollow space 53 is surrounded by a surface 52*b* inside of the first holding surface 52*a*. The first support roller 51*a* and the second support roller 51*b* are in contact with the surface 52*b* inside of the first holding surface 52*a*.

The roller 60 is rotatably supported. The roller 60 has a second holding surface 60*a*. The second holding surface 60*a* extends in a rotational direction of the roller 60. The second holding surface 60*a* is loop-shaped in the rotational direction of the roller 60. The second holding surface 60*a* is an outer circumferential surface of the roller 60.

The belt 52 and the roller 60 rotate while holding the sheet S between the first holding surface 52*a* and the second holding surface 60*a* to convey the sheet S. Specifically, the belt 52 and the roller 60 rotate while holding a portion of the sheet S between the first holding surface 52*a* and the second holding surface 60*a* to convey the sheet S. When conveying the sheet S, the belt 52 and the roller 60 also hold a portion of the sheet S between the first holding surface 52*a* and the second holding surface 60*a* while bending the portion of the sheet S along the outer circumferential surface of the roller 60. Accordingly, the belt 52 and the roller 60 rotate while holding the portion of the sheet S in a bent manner between the first holding surface 52*a* and the second holding surface 60*a* to convey the sheet S.

The roller 60 is pressed against the belt 52. As a result, a nip part Z is formed between the first holding surface 52*a* and the second holding surface 60*a*. The nip part Z holds the sheet S. The nip part Z bends along a portion of the outer circumferential surface of the roller 60. The nip part Z has a predetermined width Za in the rotational direction of the roller 60. The decurling device 20, for example, presses the roller 60 against the belt 52 and maintains the predetermined width Za by elastically altering the belt 52 in shape with pressing force of the roller 60.

The sheet S has an image formation surface S. The image formation surface S1 indicates a surface on which an image is formed of the sheet S. That is, the image formation surface S1 indicates the surface on which the ink is ejected from the image forming section 40 of the sheet S.

Generally, the sheet S curls when the ink is attached to the sheet S. In detail, an edge of the sheet S curls toward a reverse surface S2 opposite to the image formation surface S1 when the ink is attached to the image formation surface S1 of the sheet S.

According to the first embodiment, the second holding surface 60*a* faces the image formation surface S1 of the sheet S when the belt 52 and the roller 60 hold the sheet S between the first holding surface 52*a* and the second holding surface 60*a*. Accordingly, the sheet S bends toward the image formation surface S along the second holding surface 60*a* when being held between the first holding surface 52*a* and the second holding surface 60*a*. As a result, a curl can be effectively prevented from occurring in the sheet S even when the ink is attached to the image formation surface S1 of the sheet S.

As described above with reference to FIG. 2, the belt 52 and the roller 60 rotate while holding the sheet S between the first holding surface 52*a* and the second holding surface 60*a* to convey the sheet S. In this case, a curl can be prevented from occurring in the sheet S provided that a portion of the sheet S can be held between the first holding surface 52*a* and the second holding surface 60*a*. Accordingly, the belt 52 and the roller 60 may have any dimensions sufficient to hold a portion of the sheet S between the first holding surface 52*a* and the second holding surface 60*a*. As a result, the belt 52 and the roller 60 need not be enlarged, and the decurling device 20 can have a compact configuration.

Figure 3A:
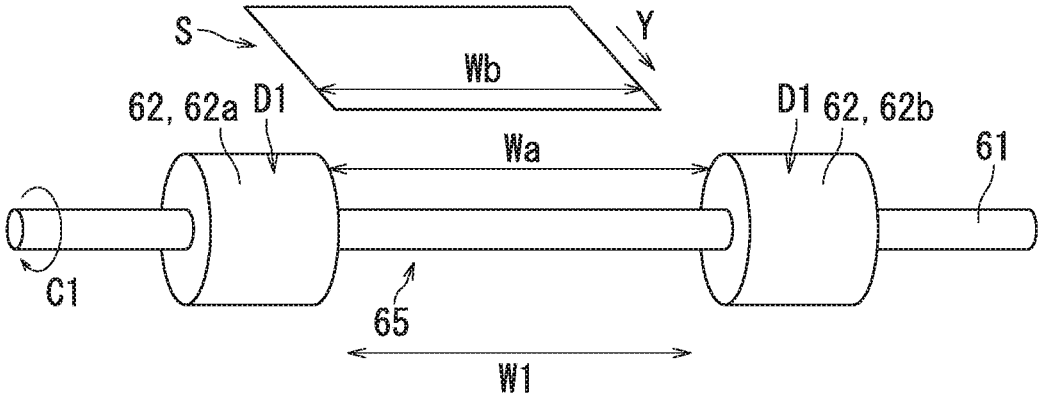
FIG. 3A is a perspective view of a shaft section and a pair of flange portions in the first embodiment.
Figure 3B:
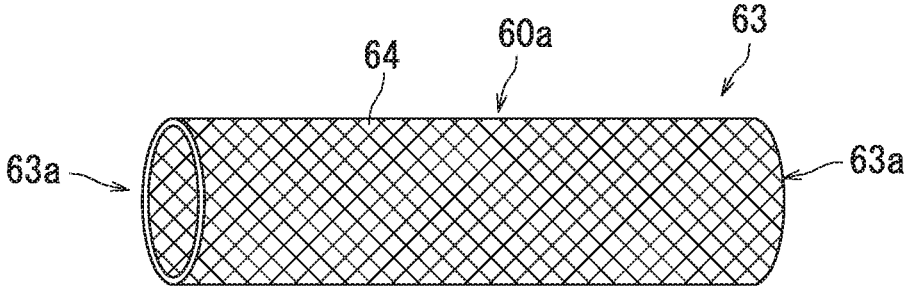
FIG. 3B is a perspective view of a trunk portion in the first embodiment.
Figure 3C:
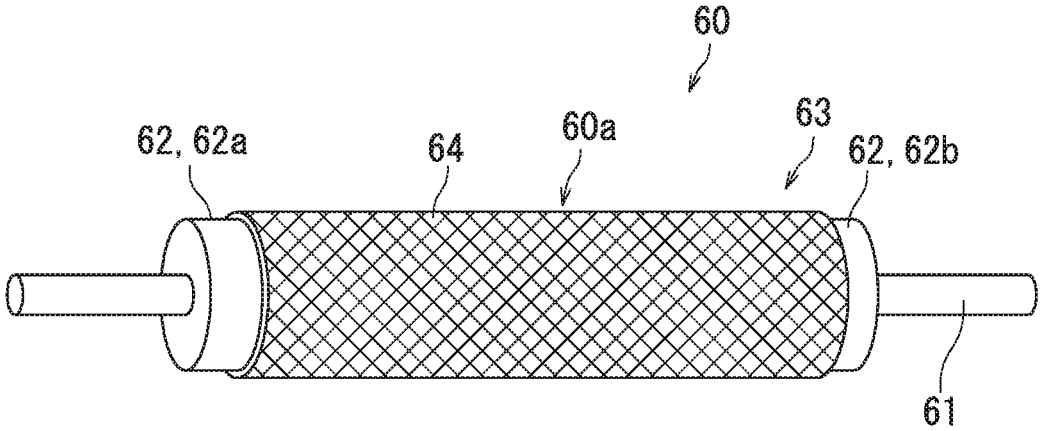
FIG. 3C is a perspective view of a roller in the first embodiment.

Next, the roller 60 will be described with reference to FIGS. 3A to 3C. FIG. 3A is a perspective view of a shaft section 61 and a pair of flange portions 62 in the first embodiment. FIG. 3B is a perspective view of a trunk portion 63 in the first embodiment. FIG. 3C is a perspective view of the roller 60 in the first embodiment.

As illustrated in FIGS. 3A to 3C, the roller 60 has the shaft section 61, the pair of flange portions 62, and the trunk portion 63.

The shaft section 61 is a rotary shaft of the roller 60. Accordingly, the roller 60 rotates around the shaft section 61.

The flange portions 62 are substantially cylindrical. The flange portions 62 are fixed to the shaft section 61. The flange portions 62 bulge outward from the shaft section 61 in a radial direction of the shaft section 61. The flange portions 62 have outer circumferential surfaces DI extending in a roller rotational direction C1. The roller rotational direction C1 means a direction in which the roller 60 rotates.

The pair of flange portions 62 includes a first flange portion 62*a* and a second flange portion 62*b*. The first flange portion 62*a* and the second flange portion 62*b* are arranged with a space therebetween in an axial direction (rotational axial direction) W1. The axial direction W1 means an extending direction of the shaft section 61.

The trunk portion 63 is cylindrical. The trunk portion 63 extends in the axial direction W1. The trunk portion 63 has openings 63 respectively formed in both ends thereof in the axial direction W1. The shaft section 61 penetrates the trunk portion 63 through the openings 63*a* in the respective ends of the trunk portion 63.

The trunk portion 63 is fixed to the flange portions 62. In detail, the trunk portion 63 is located between the first flange portion 62*a* and the second flange portion 62*b*. The first flange portion 62*a* is inserted and fixed in one of the openings 63*a* of the trunk portion 63. The second flange portion 62*b* is inserted and fixed in the other opening 63*a* of the trunk portion 63.

The trunk portion 63 rotates together with the shaft section 61 and the flange portions 62.

The trunk portion 63 is a member made from a metal, for example. An outer circumferential surface of the trunk portion 63 constitutes the second holding surface 60*a*. The second holding surface 60*a* has a plurality of through holes (second through holes) 64. According to the first embodiment, the trunk portion 63 is mesh-shaped, thus forming the through holes 64 in the second holding surface 60*a*. Each of the through holes 64 penetrates the second holding surface 60*a*. That is, each of the through holes 64 penetrates the trunk portion 63 in a place on the second holding surface 60*a*. The through holes 64 differ from each other in terms of either or both of positions in the roller rotational direction C1 and positions in the axial direction W1. Note that the through holes 64 may be staggered in the roller rotational direction C1.

A second hollow space 65 is located inside of the second holding surface 60*a*. The second hollow space 65 means a space formed inside of the second holding surface 60*a*. The second hollow space 65 is formed between the pair of flange portions 62. In other words, the second hollow space 65 is formed inside of the roller 60.

A dimension Wa of the second hollow space 65 in the axial direction W1 is greater than a dimension Wb of the sheet S in a width direction thereof (Wa>Wb). Accordingly, the sheet S faces the second hollow space 65 with the second holding surface 60*a* therebetween when the sheet S is held between the first holding surface 52*a* and the second holding surface 60*a*. Note that the width direction of the sheet S means a direction perpendicular to the conveyance direction Y.

Each of the through holes 64 provides communication between an exterior of the roller 60 and the second hollow space 65.

Figure 4:
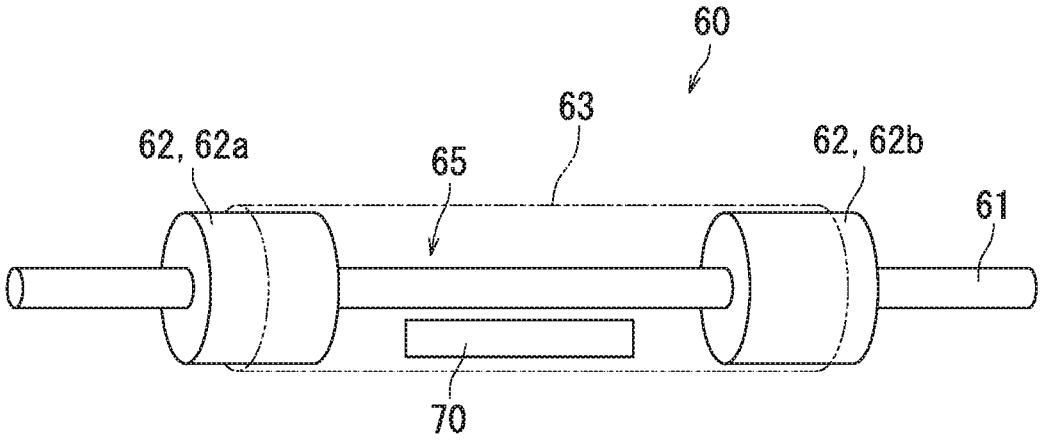
FIG. 4 is a diagram illustrating an installation place of a heat source.

Next, the heat source 70 will be described with reference to FIG. 4. FIG. 4 is a diagram illustrating an installation place of the heat source 70.

As illustrated in FIG. 4, the heat source 70 is a member capable of heat generation. The heat source 70 includes a halogen heater or a ceramic heater, for example. The heat source 70 heats the roller 60. Specifically, the heat source 70 heats the second holding surface 60*a*. The heat source 70, for example, heats the second holding surface 60*a* so as to increase the temperature of the second holding surface 60*a* to approximately 100° C. The heat source 70 is disposed at the roller 60. The heat source 70 being disposed at the roller 60 indicates that the heat source 70 is provided within the roller 60, or that the heat source 70 is in direct or indirect contact with the second holding surface 60*a*. That is, the heat source 70 may be provided within the roller 60. The heat source 70 may alternatively be in direct or indirect contact with the second holding surface 60*a*.

According to the first embodiment, the heat source 70 is provided within the roller 60. Specifically, the heat source 70 is disposed in the second hollow space 65. The heat source 70, for example, does not rotate together with the roller 60 and is stationary. As a result, power can be provided to the heat source 70 through a simple configuration. Also, the heat source 70 may or may not be in contact with a reverse surface opposite to the second holding surface 60*a*. The heat source 70 may be in contact with the reverse surface opposite to the second holding surface 60*a* through a protective member. The protective member is a sliding sheet, for example. The protective member prevents abrasion of both the heat source 70 and the reverse surface of the second holding surface 60*a*.

Figure 5:
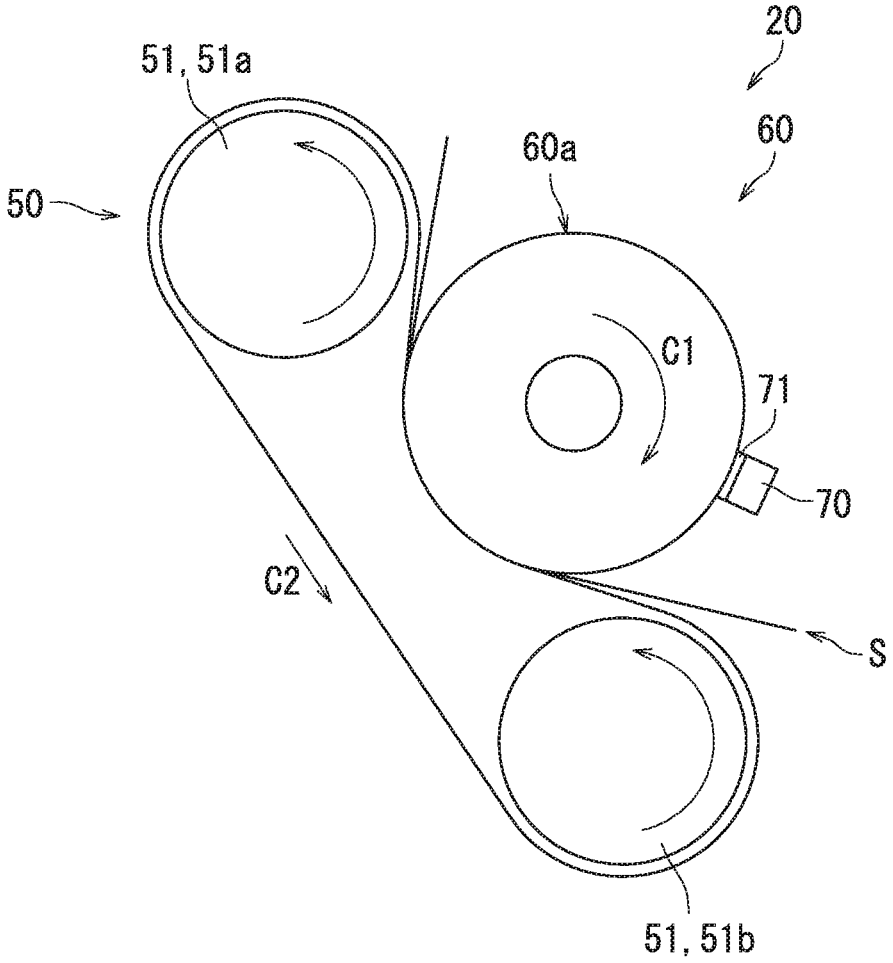
FIG. 5 is a diagram illustrating a variation of the installation place of the heat source.

Next, a variation of the installation place of the heat source 70 will be described with reference to FIG. 5. FIG. 5 is a diagram illustrating the variation of the installation place of the heat source 70.

The heat source 70 illustrated in FIG. 5 differs from the heat source 70 illustrated in FIG. 4 in that in FIG. 5, the heat source 70 is in contact with the second holding surface 60*a*.

As illustrated in FIG. 5, the heat source 70 is disposed outside of the roller 60. The heat source 70 is in contact with the second holding surface 60*a*. Specifically, the heat source 70 is in indirect contact with the second holding surface 60*a* through a protective member 71 such as a sliding sheet. Accordingly, heat of the heat source 70 is conducted to the second holding surface 60*a*. Specifically, the heat of the heat source 70 is conducted to the second holding surface 60*a* through the protective member 71. As a result, the second holding surface 60*a* can be heated.

As described above with reference to FIG. 4, the heat source 70 heats the roller 60. In this case, the heat of the heat source 70 can be easily transmitted to the roller 60 by disposing the heat source 70 at the roller 60 such that the heat source 70 is adjacent to the roller 60. As a result, the roller 60 can be efficiently heated with the heat of the heat source 70. Also, by disposing the heat source 70 at the roller 60, the heat source 70 can be disposed adjacent to the roller 60, and thus the decurling device 20 can have a compact configuration.

Figure 6:
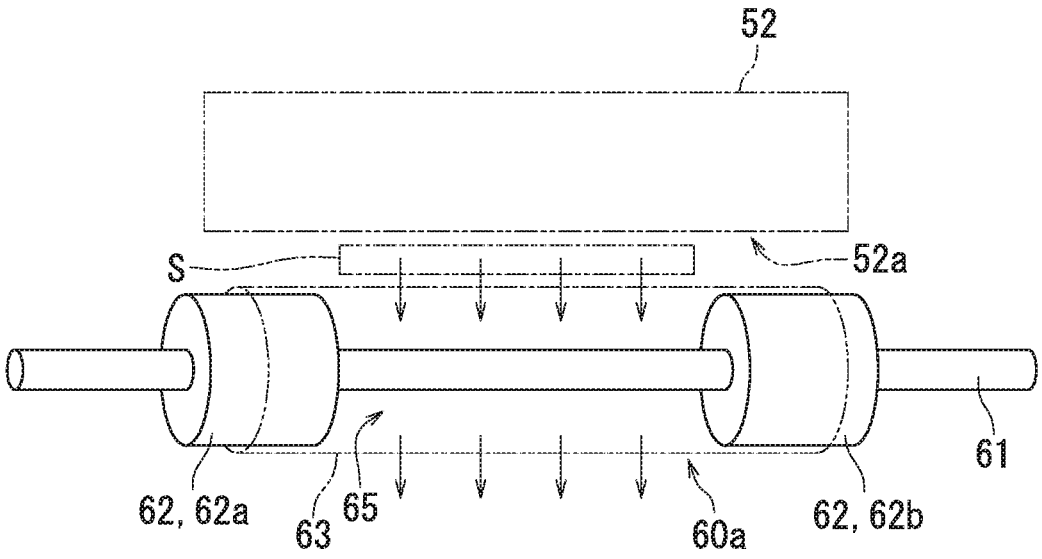
FIG. 6 is a diagram illustrating a state where the decurling device of the first embodiment dries ink attached to a sheet.

Next, a principle by which the decurling device 20 of the first embodiment accelerates drying of the ink attached to the sheet S will be described with reference to FIG. 6. FIG. 6 is a diagram illustrating a state where the decurling device 20 of the first embodiment dries the ink attached to the sheet S.

As illustrated in FIG. 6, while the heat source 70 is generating heat, the heat of the heat source 70 is transmitted to the sheet S through the second holding surface 60*a* when the first holding surface 52*a* and the second holding surface 60*a* rotate while holding the sheet S therebetween. When the heat of the heat source 70 is transmitted to the sheet S, the sheet S is heated. When the sheet S is heated, moisture of the ink attached to the sheet S evaporates. The resulting vapor is discharged to the exterior of the roller 60 through the through holes 64 after flowing into the second hollow space 65 through the through holes 64 (refer to FIG. 3C). That is, the through holes 64 function as an escape path for the vapor generated by heating the sheet S. As a result, the drying of the ink attached to the sheet S is accelerated.

As described above with reference to FIG. 6, the second holding surface 60*a* has the through holes 64. Accordingly, the ink moisture vapor originating from the sheet S due to the heat of the heat source 70 can be discharged through the through holes 64 from between the first holding surface 52*a* and the second holding surface 60*a* when the first holding surface 52*a* and the second holding surface 60*a* rotate while holding the sheet S therebetween to convey the sheet S. As a result, the drying of the ink attached to the sheet S can be accelerated and a curl can be prevented from occurring in the sheet S.

Second Embodiment

An inkjet recording apparatus 1 according to a second embodiment of the present disclosure will be described with reference to FIGS. 7A to 8.

The second embodiment differs from the first embodiment in that according to the second embodiment, a heat source 70 heats a first holding surface 52*a*. In the following, points of difference between the first and second embodiments will be mainly described.

A decurling device 20 of the second embodiment will be described with reference to FIGS. 7A and 7B. FIG. 7A is a diagram illustrating the decurling device 20 of the second embodiment. FIG. 7B is a diagram in which a belt 52 of the decurling device 20 illustrated in FIG. 7A is viewed from an arrow E direction.

Figure 7A:
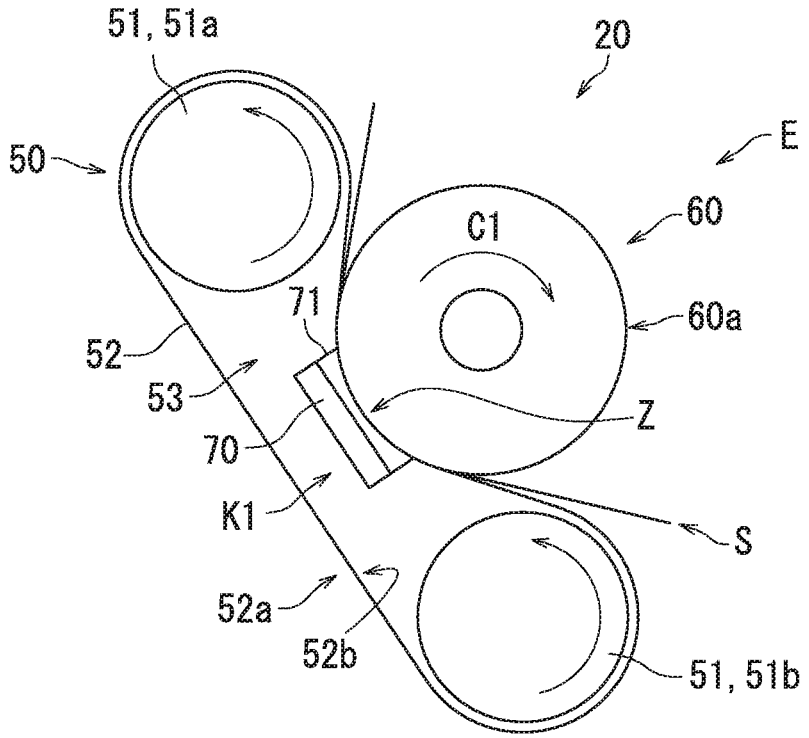
FIG. 7A is a diagram illustrating a decurling device of a second embodiment.
Figure 7B:
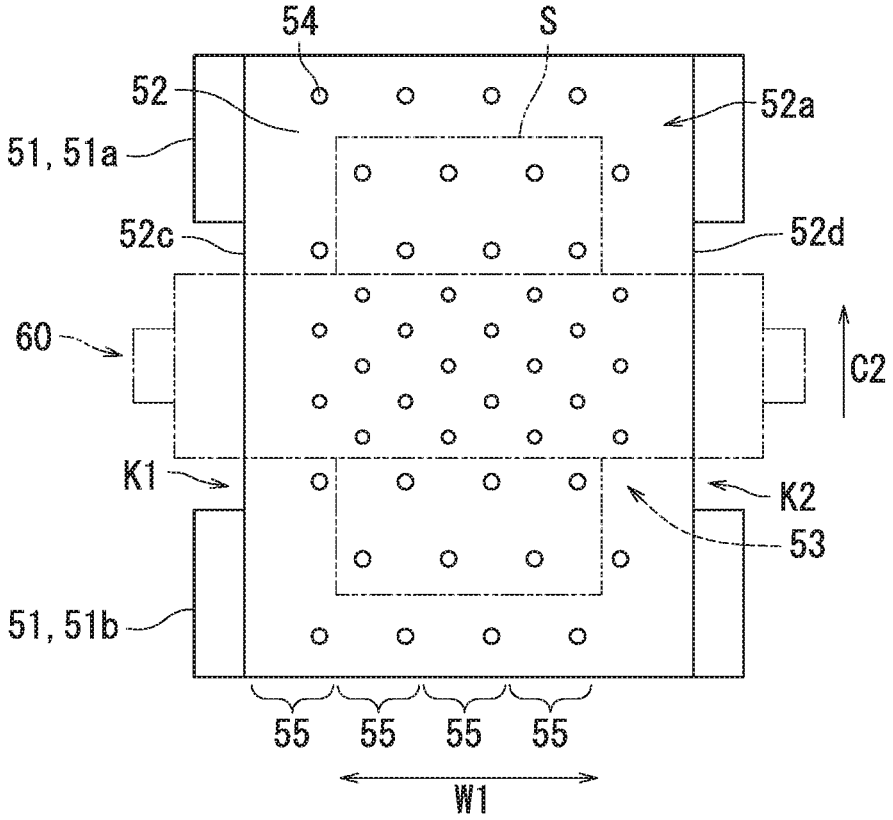
FIG. 7B is a diagram in which a belt of the decurling device illustrated in FIG. 7A is viewed from an arrow E direction.

As illustrated in FIGS. 7A and 7B, the first holding surface 52*a* of the belt 52 has a plurality of belt through holes (first through holes) 54. Each of the belt through holes 54 penetrates the first holding surface 52*a*. That is, each of the belt through holes 54 penetrates the belt 52 in a place on the first holding surface 52*a*. The belt through holes 54 differ from each other in terms of either or both of positions in a belt rotational direction C2 and positions in an axial direction W1. The belt rotational direction C2 means a direction in which the belt 52 rotates. According to the second embodiment, a plurality of rows 55 of the belt through holes 54 is provided in the axial direction W1. The belt through holes 54 are staggered in the belt rotational direction C2.

A sheet S faces a first hollow space 53 with the first holding surface 52*a* therebetween when the first holding surface 52*a* and a second holding surface 60*a* hold the sheet S.

Each of the belt through holes 54 provides communication between an exterior of the belt 52 and the first hollow space 53.

The heat source 70 heats the belt 52. Specifically, the heat source 70 heats the first holding surface 52*a*. The heat source 70, for example, heats the first holding surface 52*a* so as to increase the temperature of the first holding surface 52*a* to approximately 100° C. The heat source 70 is disposed at the belt 52. The heat source 70 being disposed at the belt 52 indicates that the heat source 70 is provided within the belt 52, that the heat source 70 is in direct or indirect contact with the first holding surface 52*a*, or that the heat source 70 is provided within at least one of a plurality of support rollers 51. That is, the heat source 70 may be provided within the belt 52. The heat source 70 may alternatively be in direct or indirect contact with the first holding surface 52*a*. The heat source 70 may alternatively be provided within at least one of the support rollers 51. Note that the heat source 70 being provided within the belt 52 means that the heat source 70 is disposed inside of the belt 52. The inside of the belt 52 indicates the first hollow space 53.

According to the second embodiment, the heat source 70 is provided within the belt 52. Specifically, the heat source 70 is disposed in the first hollow space 53. The heat source 70 is also in indirect contact with a surface 52*b* inside of the first holding surface 52*a* through a protective member 71. The heat source 70 faces a nip part Z. In detail, the heat source 70 faces the nip part Z with the protective member 71 therebetween.

As described above with reference to FIGS. 7A and 7B, the heat source 70 heats the belt 52. In this case, heat of the heat source 70 is more easily transmitted to the belt 52 by disposing the heat source 70 at the belt 52 such that the heat source 70 is adjacent to the belt 52. As a result, the belt 52 can be efficiently heated with the heat of the heat source 70. Also, by disposing the heat source 70 at the belt 52, the heat source 70 can be disposed adjacent to the belt 52, and thus the decurling device 20 can have a compact configuration.

Next, a principle by which the decurling device 20 of the second embodiment accelerates drying of ink attached to the sheet S will be described with reference to FIG. 8. FIG. 8 is a diagram illustrating a state where the decurling device 20 of the second embodiment dries the ink attached to the sheet S.

Figure 8:
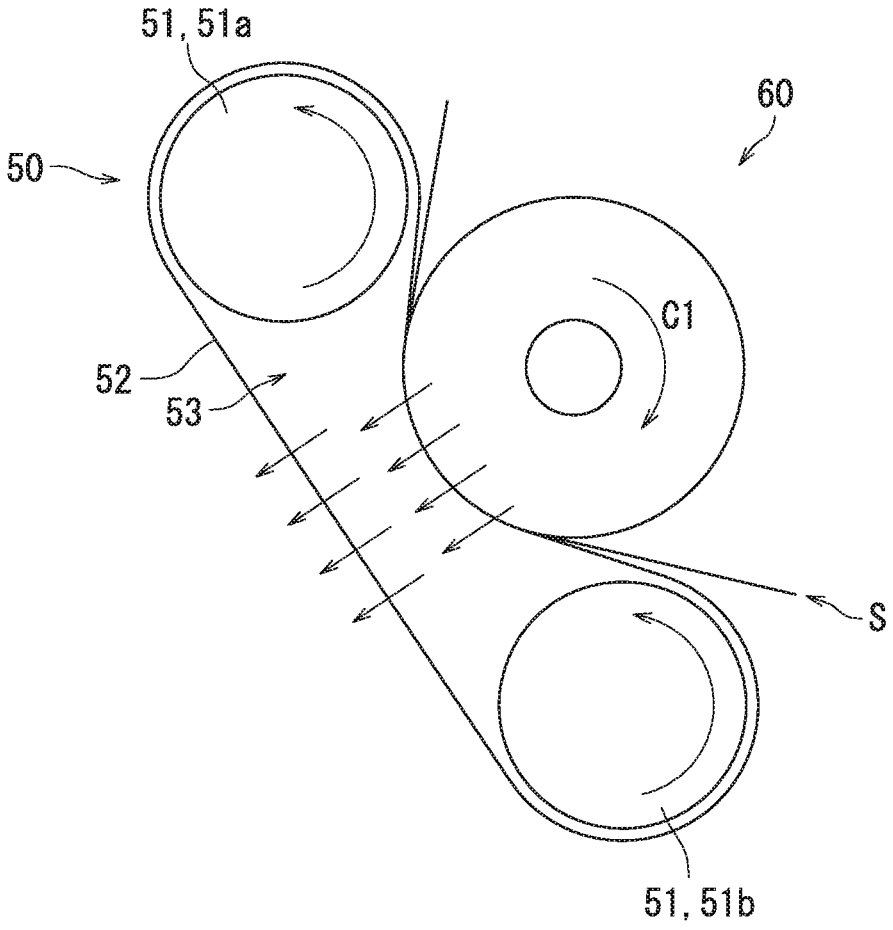
FIG. 8 is a diagram illustrating a state where the decurling device of the second embodiment dries ink attached to a sheet.

As illustrated in FIG. 8, while the heat source 70 is generating heat, the heat of the heat source 70 is transmitted to the sheet S through the first holding surface 52*a* when the first holding surface 52*a* and the second holding surface 60*a* rotate while holding the sheet S therebetween. When the heat of the heat source 70 is transmitted to the sheet S, the sheet S is heated. When the sheet S is heated, moisture of the ink attached to the sheet S evaporates. The resulting vapor is discharged to the exterior of the belt 52 through the belt through holes 54 after flowing into the first hollow space 53 through the belt through holes 54 (refer to FIG. 7B). That is, the belt through holes 54 function as escape paths for the vapor generated by heating the sheet S. As a result, the drying of the ink attached to the sheet S can be accelerated.

As described above with reference to FIG. 8, the first holding surface 52*a* has the belt through holes 54. Accordingly, the ink moisture vapor originating from the sheet S due to the heat of the heat source 70 can be discharged through the belt through holes 54 from between the first holding surface 52*a* and the second holding surface 60*a* when the first holding surface 52*a* and the second holding surface 60*a* rotate while holding the sheet S therebetween to convey the sheet S. As a result, the drying of the ink attached to the sheet S can be accelerated and a curl can be prevented from occurring in the sheet S.

Third Embodiment

An inkjet recording apparatus 1 according to a third embodiment of the present disclosure will be described with reference to FIGS. 9A to 10.

The third embodiment differs from the first embodiment in that in the third embodiment, a mechanism is provided which discharges ink moisture vapor to an exterior 2*a* of a casing 2. In the following, points of difference between the first and third embodiments will be mainly described.

A roller 60 of the third embodiment will be described with reference to FIGS. 9A to 9C. FIG. 9A is a perspective view of a shaft section 61 and a pair of flange portions 62 in the third embodiment. FIG. 9B is a perspective view of a trunk portion 63 in the third embodiment. FIG. 9C is a perspective view of the roller 60 in the third embodiment.

Figure 9A:
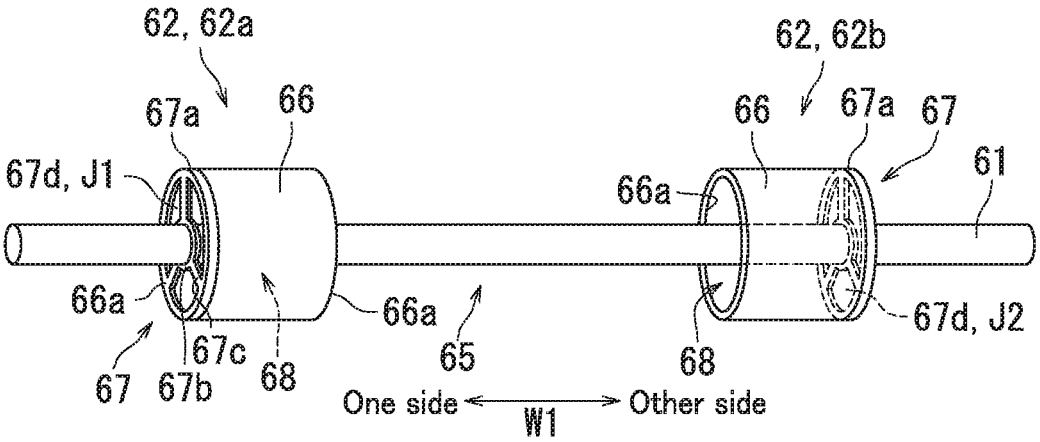
FIG. 9A is a perspective view of a shaft section and a pair of flange portions in a third embodiment.
Figure 9B:
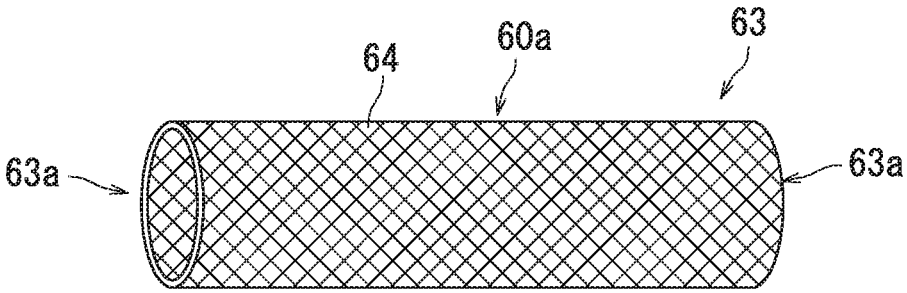
FIG. 9B is a perspective view of a trunk portion in the third embodiment.
Figure 9C:
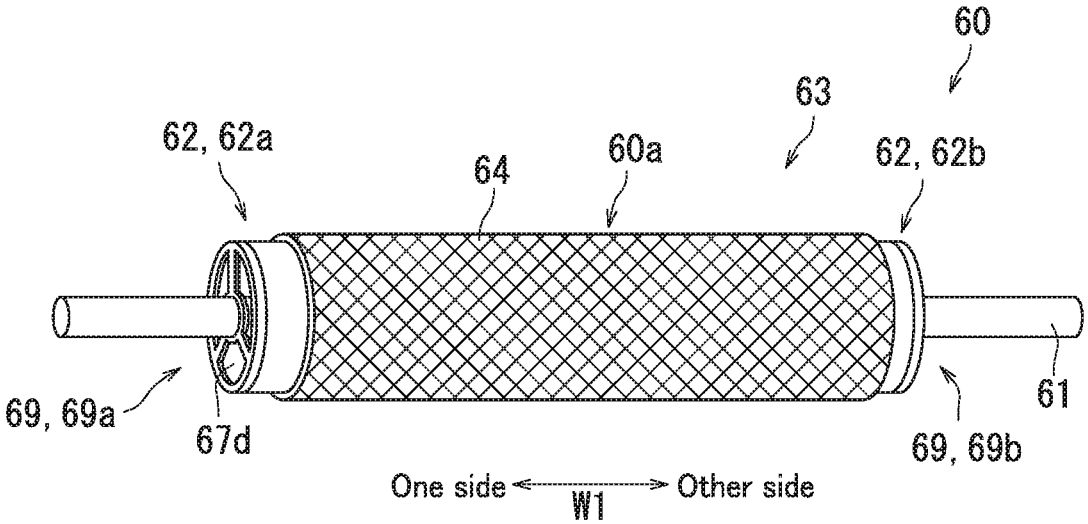
FIG. 9C is a perspective view of a roller in the third embodiment.

As illustrated in FIG. 9A to 9C, the roller 60 has the shaft section 61, the pair of flange portions 62 (a first flange portion 62*a* and a second flange portion 62*b*), and the trunk portion 63. An unillustrated heat source 70 is provided within the roller 60.

The first flange portion 62*a* and the second flange portion 62*b* have the same configuration. Accordingly, only the configuration of the first flange portion 62*a* will be described.

The first flange portion 62*a* has a bushing 66 and a cap 67.

The bushing 66 is cylindrical. The bushing 66 has openings 66*a* formed in both ends thereof in an axial direction W1.

The cap 67 has a frame 67*a*, a fixing section 67*b*, and supporting sections 67*c*. The frame 67*a* is substantially ring-shaped. The frame 67*a* and rims of the openings 66*a* have substantially the same shape. The frame 67*a* is fixed to one of the openings 66*a* of the bushing 66. The fixing section 67*b* is disposed at a center portion inside of the frame 67*a*. An inner diameter of the frame 67*a* is larger than an outer diameter of the fixing section 67*b*. Accordingly, a space is formed between the frame 67*a* and the fixing section 67*b*.

The supporting sections 67*c* are interposed between the frame 67*a* and the fixing section 67*b*. The supporting sections 67*c* each extend in a radial direction of the opening 66*a*. The supporting sections 67*c* are arranged with spaces therebetween in a circumferential direction of the bushing 66. Openings 67*d* are formed between the adjoining supporting sections 67*c*, the frame 67*a*, and the fixing section 67*b*.

The fixing section 67*b* is fixed to the frame 67*a* through the supporting sections 67*c*. As a result, the position of the fixing section 67*b* is held so that the fixing section 67*b* is located in the center portion inside of the frame 67*a*.

The shaft section 61 penetrates the first flange portion 62*a* through the openings 66*a* in the respective ends of the bushing 66. The shaft section 61 is fixed to the fixing section 67*b*. An outer diameter of the shaft section 61 is smaller than an inner diameter of the bushing 66. Accordingly, a third hollow space 68 is formed between an outer circumferential surface of the shaft section 61 and an inner circumferential surface of the bushing 66.

The first flange portion 62*a* and the second flange portion 62*b* are arranged with a space therebetween in the axial direction W1. The cap 67 of the first flange portion 62*a* and a cap 67 of the second flange portion 62*b* are located outward in the axial direction W1.

A second hollow space 65 is formed between the first flange portion 62*a* and the second flange portion 62*b*. The second hollow space 65 is enclosed by the trunk portion 63.

An inlet (second inlet) J1 is located on one side of the second hollow space 65 in the axial direction W1. The inlet J1 means the openings 67*d* formed in the first flange portion 62*a*. The inlet J1 connects to an exterior of the roller 60. The inlet J1 also connects to the second hollow space 65. In detail, the inlet J1 connects to the second hollow space 65 through the third hollow space 68 of the first flange portion 62*a*.

An outlet (second outlet) J2 is located on the other side of the second hollow space 65 in the axial direction W1. The outlet J2 means the openings 67*d* formed in the second flange portion 62*b*. The outlet J2 connects to the exterior of the roller 60. The outlet J2 also connects to the second hollow space 65. In detail, the outlet J2 connects to the second hollow space 65 through the third hollow space 68 of the second flange portion 62*b*.

Next, a decurling device 20 according to the third embodiment will be described with reference to FIG. 10. FIG. 10 is a diagram illustrating the decurling device 20 of the third embodiment.

Figure 10:
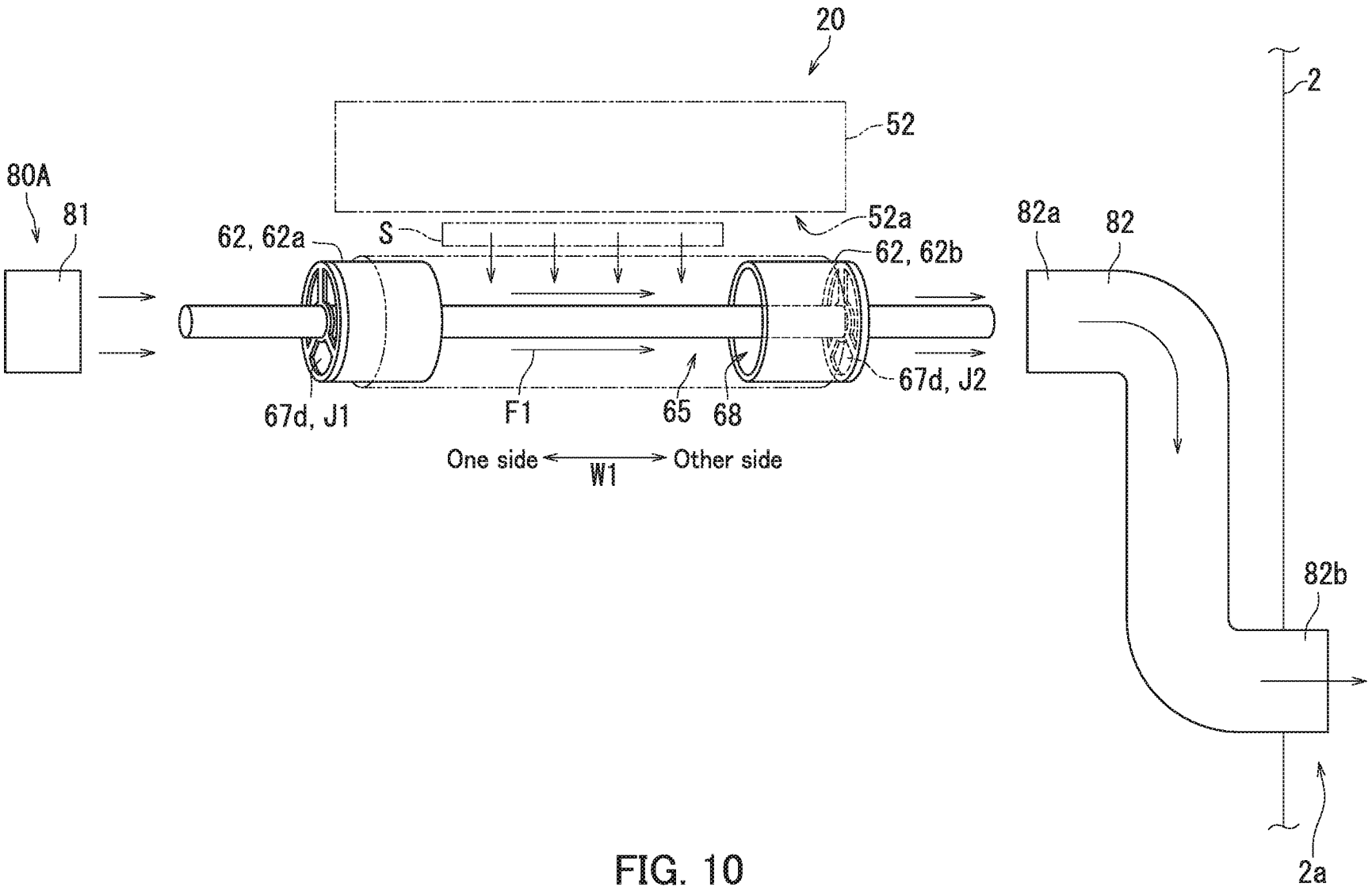
FIG. 10 is a diagram illustrating a decurling device of the third embodiment.

As illustrated in FIG. 10, the decurling device 20 further includes a discharging mechanism 80A. The discharging mechanism 80A discharges the ink moisture vapor that has flowed into the second hollow space 65 to the exterior of the roller 60.

The discharging mechanism 80A has a roller air blowing section (second air blowing section) 81 and a pipe (second pipe) 82.

The roller air blowing section 81 is a fan, for example. The roller air blowing section 81 blows air (second air) F1 into the roller 60. The roller air blowing section 81 blows the air F1 toward the other side in the axial direction W1. The roller air blowing section 81 also blows the air F1 toward the inlet J1.

The air F1 flows into the inlet J1. The air F1 then flows into the second hollow space 65. The air F1 then flows out from the outlet J2. Accordingly, the roller air blowing section 81 blows the air F1 so that the air F1 flows out to the exterior of the roller 60 through the outlet J2 after flowing into the second hollow space 65 through the inlet J1.

The pipe 82 is a duct, for example. The pipe 82 is pipe-shaped and has openings formed in both ends thereof. One end of the pipe 82 has a first opening 82*a*. The other end of the pipe 82 has a second opening 82*b*.

The pipe 82 connects to the outlet J2 and to the exterior 2*a* of the casing 2. Specifically, the first opening 82*a* of the pipe 82 connects to the outlet J2 and the second opening 82*b* of the pipe 82 connects to the exterior 2*a* of the casing 2.

The pipe 82 connecting to the outlet J2 indicates that the air F1 that has flowed out from the outlet J2 can flow into the first opening 82*a*. The first opening 82*a* is disposed in a position facing the outlet J2 and adjacent to the outlet J2, for example. The pipe 82 connecting to the exterior 2*a* of the casing 2 indicates that the second opening 82*b* is disposed on the exterior 2*a* of the casing 2.

Next, a principle by which the decurling device 20 of the third embodiment accelerates drying of ink attached to a sheet S will be described with reference to FIG. 10.

As illustrated in FIG. 10, while the heat source 70 is generating heat, the heat of the heat source 70 is transmitted to the sheet S through a second holding surface 60*a* when a first holding surface 52*a* and the second holding surface 60*a* rotate while holding the sheet S therebetween. The sheet S is heated when the heat of the heat source 70 is transmitted to the sheet S. When the sheet S is heated, the moisture of the ink attached to the sheet S evaporates. The resulting vapor flows into the second hollow space 65 through a plurality of through holes 64 (refer to FIG. 9C). The roller air blowing section 81 blows the air F1 into the second hollow space 65 and conveys the vapor in the second hollow space 65 with pressure of the air F1. The roller air blowing section 81 then discharges the vapor in the second hollow space 65 from the outlet J2 and causes the vapor to flow into the pipe 82 with the pressure of the air F1. The air F1 flows into the pipe 82 through the first opening 82*a*. The roller air blowing section 81 conveys the vapor through the pipe 82 with the pressure of the air F1. The roller air blowing section 81 then discharges the vapor to the exterior 2*a* of the casing 2 with the pressure of the air F1. The vapor is discharged to the exterior 2*a* of the casing 2 through the second opening 82*b*.

As described above with reference to FIGS. 9A to 10, the roller 60 has the inlet J1 and the outlet J2. The inlet 1 and the outlet J2 each connect to the second hollow space 65. The air F1 blown by the roller air blowing section 81 flows into the inlet J1. The air F1 flows out from the outlet J2. Accordingly, the ink moisture vapor that has flowed into the second hollow space 65 through the through holes 64 is discharged out of the second hollow space 65 through the outlet J2 with the pressure of the air F1. As a result, the drying of the ink attached to the sheet S is accelerated and a curl can be prevented from occurring in the sheet S.

The pipe 82 connects to the outlet J2 and to the exterior 2*a* of the casing 2. Accordingly, the ink moisture vapor discharged from the outlet J2 is discharged to the exterior 2*a* of the casing 2 through the pipe 82 with the pressure of the air F1. As a result, the vapor can be prevented from accumulating inside of the casing 2, and the drying of the ink attached to the sheet S can be effectively accelerated.

Fourth Embodiment

Figure 11:
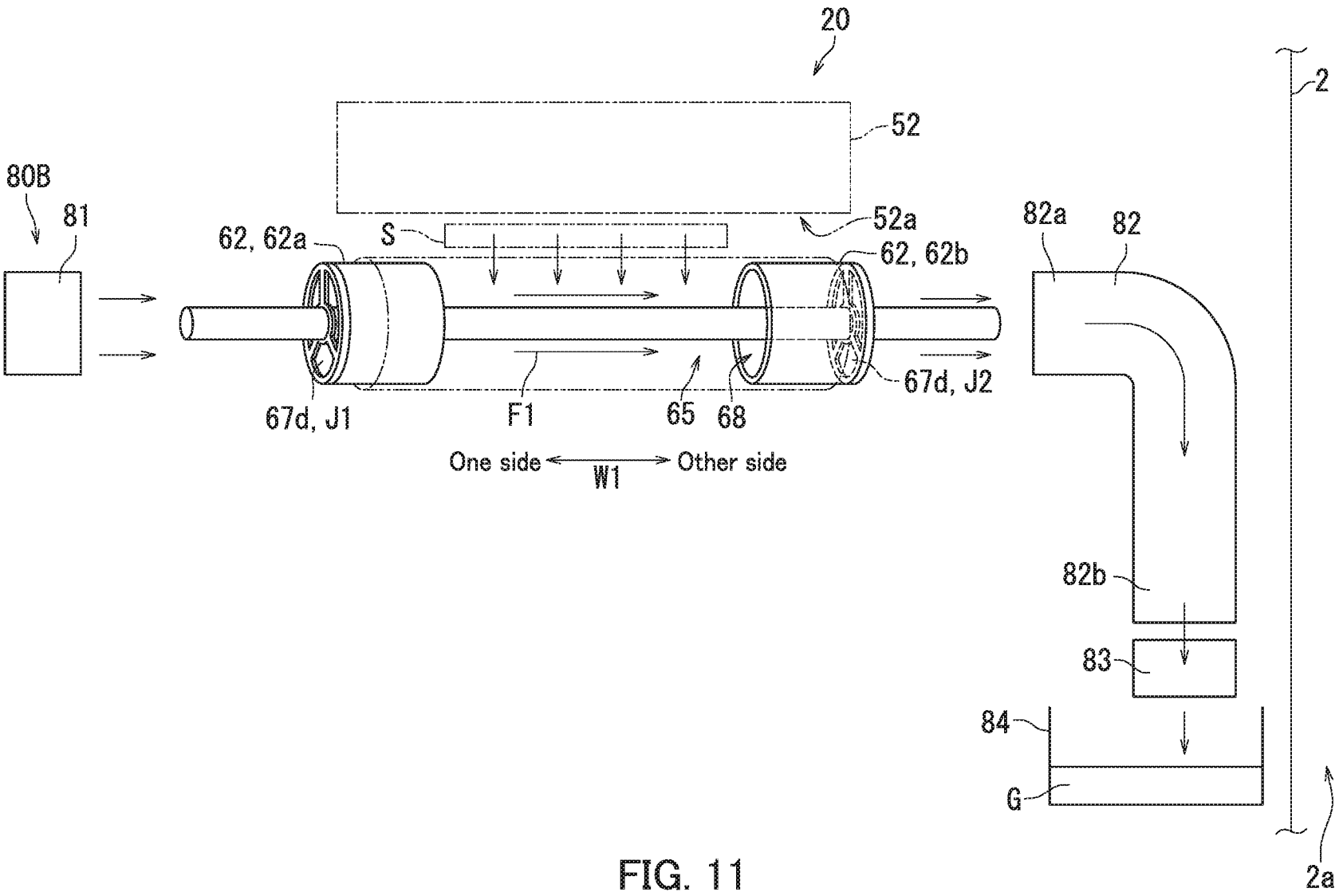
FIG. 11 is a diagram illustrating a decurling device of a fourth embodiment.

Next, an inkjet recording apparatus 1 according to a fourth embodiment of the present disclosure will be described with reference to FIG. 11. FIG. 11 is a diagram illustrating a decurling device 20 of the fourth embodiment.

The fourth embodiment differs from the third embodiment in that in the fourth embodiment, a mechanism is provided to condense ink moisture vapor into water G and house the water G In the following, points of difference between the third and fourth embodiments will be mainly described.

As illustrated in FIG. 11, the decurling device 20 further includes a discharging mechanism 80B. The discharging mechanism 80B condenses the ink moisture vapor that has flowed into a second hollow space 65 into the water G and houses the water G.

The discharging mechanism 80B has a roller air blowing section 81, a pipe 82, a cooling section 83, and a housing section 84.

The pipe 82 connects to an outlet J2 and to the cooling section 83. Specifically, a first opening 82*a* of the pipe 82 connects to the outlet J2 and a second opening 82*b* of the pipe 82 connects to the cooling section 83.

The pipe 82 connecting to the cooling section 83 indicates that air F1 that has flowed out from the second opening 82*b* can flow into the cooling section 83. Specifically, the cooling section 83 is connected to the second opening 82*b*.

The cooling section 83 cools the vapor to condense the vapor into the water G. The cooling section 83 cools the vapor using refrigerant, for example.

The housing section 84 houses the water G created by the cooling section 83. The housing section 84 is a container, for example. The housing section 84 directly or indirectly connects to the cooling section 83.

Continuing, a principle by which the decurling device 20 of the fourth embodiment accelerates drying of ink attached to a sheet S will be described with reference to FIG. 11.

As illustrated in FIG. 11, while a heat source 70 is generating heat, the moisture of the ink attached to the sheet S is heated with the heat of the heat source 70 and evaporates when a first holding surface 52*a* and a second holding surface 60*a* rotate while holding the sheet S therebetween. The resulting vapor flows into the second hollow space 65 through a plurality of through holes 64 (refer to FIG. 9C). The roller air blowing section 81 then discharges the vapor in the second hollow space 65 from the outlet J2 and causes the vapor to flow into the pipe 82 with pressure of the air F1. The roller air blowing section 81 conveys the vapor through the pipe 82 with the pressure of the air F1. The roller air blowing section 81 then supplies the vapor to the cooling section 83 with the pressure of the air F1. The cooling section 83 cools the vapor to condense the vapor into the water G. The housing section 84 then houses the water G created by the cooling section 83.

As described above with reference to FIG. 11, the pipe 82 connects to the outlet J2 and to the cooling section 83. The housing section 84 also connects to the cooling section 83. Accordingly, the ink moisture vapor discharged from the outlet J2 is supplied to the cooling section 83 through the pipe 82 with the pressure of the air F1. The vapor is then condensed into the water G by the cooling section 83 and discharged to the housing section 84. As a result, the vapor is prevented from accumulating inside of a casing 2, and the drying of the ink attached to the sheet S can be effectively accelerated.

Fifth Embodiment

Figure 12:
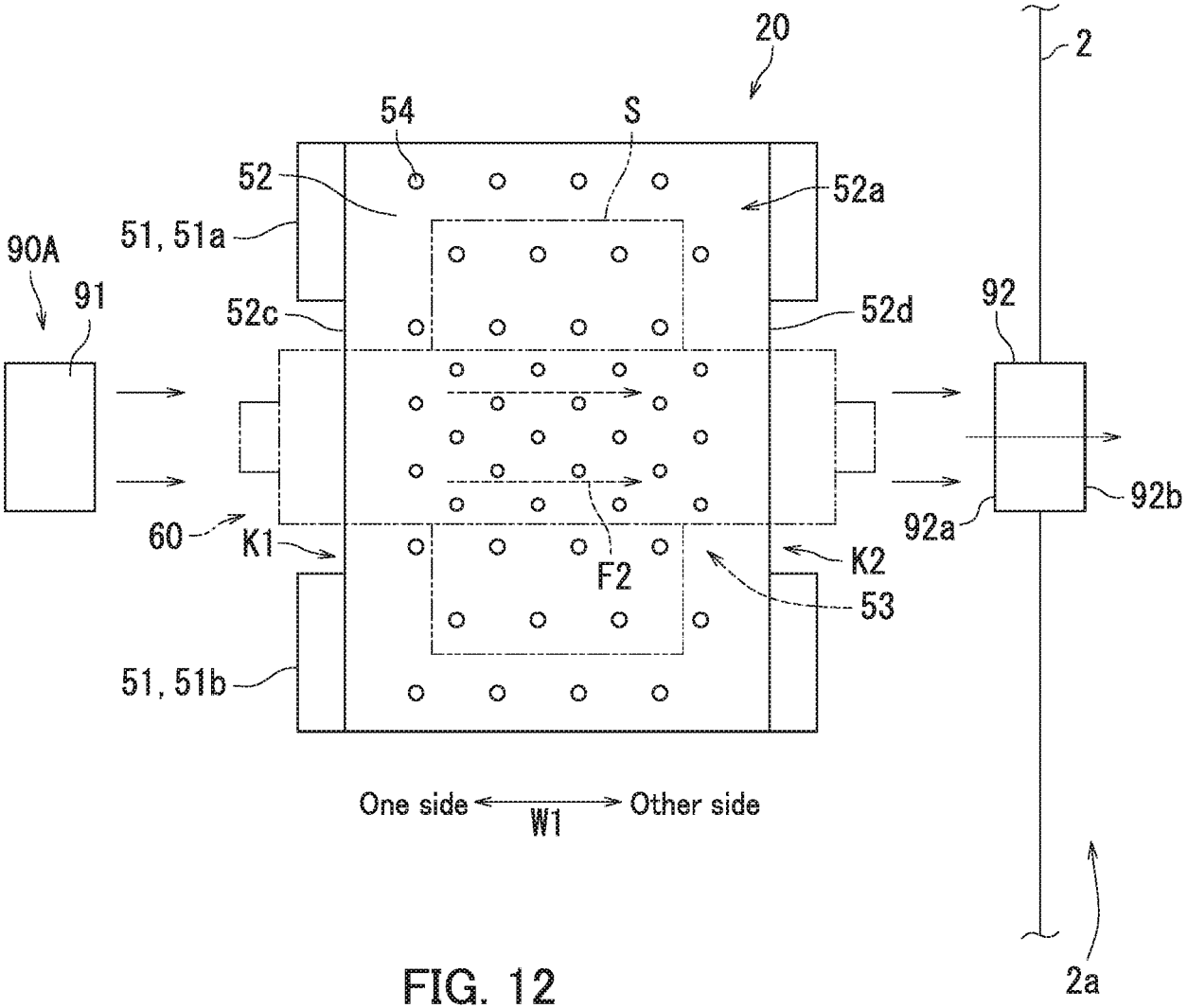
FIG. 12 is a diagram illustrating a decurling device of a fifth embodiment.

Next, an inkjet recording apparatus 1 according to a fifth embodiment of the present disclosure will be described with reference to FIG. 12. FIG. 12 is a diagram illustrating a decurling device 20 of the fifth embodiment.

The fifth embodiment differs from the second embodiment in that in the fifth embodiment, a mechanism is provided which discharges ink moisture vapor to an exterior 2*a* of a casing 2. In the following, points of difference between the second and fifth embodiments will be mainly described.

As illustrated in FIG. 12, a belt 52 has an inlet (first inlet) K1 and an outlet (first outlet) K2. The inlet K1 indicates space surrounded by a rim 52*c* on one side of the belt 52 in an axial direction W1. The outlet K2 indicates space surrounded by a rim 52*d* on the other side of the belt 52 in the axial direction W1. The rim 52*c* on the one side and the rim 52*d* on the other side extend in a belt rotational direction C2. The inlet K1 and the outlet K2 each connect to a first hollow space 53 (refer to FIGS. 7A and 7B). The inlet K1 and the outlet K2 also each provide communication between an exterior of the belt 52 and the first hollow space 53.

The decurling device 20 further includes a discharging mechanism 90A. The discharging mechanism 90A discharges the ink moisture vapor that has flowed into the first hollow space 53 to the exterior of the belt 52.

The discharging mechanism 90A has a belt air blowing section (first air blowing section) 91 and a pipe (first pipe) 92.

The belt air blowing section 91 is a fan, for example. The belt air blowing section 91 blows air (first air) F2 into the belt 52. The belt air blowing section 91 blows the air F2 toward the other side in the axial direction W1. The belt air blowing section 91 also blows the air F2 toward the inlet K1.

The air F2 flows into the inlet K1. The air F2 then flows into the first hollow space 53. The air F2 then flows out from the outlet K2. Accordingly, the belt air blowing section 91 blows the air F2 so that the air F2 flows out of the belt 52 through the outlet K2 after flowing into the first hollow space 53 through the inlet K1.

The pipe 92 is a duct, for example. The pipe 92 is pipe-shaped and has openings formed in both ends thereof. One end of the pipe 92 has a first opening 92*a*. The other end of the pipe 92 has a second opening 92*b*.

The pipe 92 connects to the outlet K2 and to the exterior 2*a* of the casing 2. Specifically, the first opening 92*a* of the pipe 92 connects to the outlet K2 and the second opening 92*b* of the pipe 92 connects to the exterior 2*a* of the casing 2.

Continuing, a principle by which the decurling device 20 of the fifth embodiment accelerates drying of ink attached to a sheet S will be described with reference to FIG. 12.

As illustrated in FIG. 12, while a heat source 70 is generating heat, moisture of the ink attached to the sheet S is heated with the heat of the heat source 70 and evaporates when a first holding surface 52*a* and a second holding surface 60*a* rotate while holding the sheet S therebetween. The resulting vapor flows into the first hollow space 53 through a plurality of belt through holes 54 (refer to FIG. 8). The belt air blowing section 91 discharges the vapor inside the first hollow space 53 from the outlet K2 and causes the vapor to flow into the pipe 92 through the first opening 92*a* with pressure of the air F2. The belt air blowing section 91 then conveys the vapor through the pipe 92 with the pressure of the air F2. The belt air blowing section 91 then discharges the vapor to the exterior 2*a* of the casing 2 with the pressure of the air F2. Specifically, the vapor is discharged to the exterior 2*a* of the casing 2 through the second opening 92*b*.

As described above with reference to FIG. 12, the belt 52 has the inlet K1 and the outlet K2. The inlet K1 and the outlet K2 each connect to the first hollow space 53. The air F2 blown by the belt air blowing section 91 flows into the inlet K1. The air F2 flows out from the outlet K2. Accordingly, the ink moisture vapor that has flowed into the first hollow space 53 through the belt through holes 54 is discharged out of the first hollow space 53 through the outlet K2 with the pressure of the air F2. As a result, the drying of the ink attached to the sheet S is accelerated and a curl can be prevented from occurring in the sheet S.

The pipe 92 connects to the outlet K2 and to the exterior 2*a* of the casing 2. Accordingly, the ink moisture vapor discharged from the outlet K2 is discharged to the exterior 2*a* of the casing 2 through the pipe 92 with the pressure of the air F2. As a result, the vapor is prevented from accumulating inside of the casing 2 and the drying of the ink attached to the sheet S can be effectively accelerated.

Sixth Embodiment

Figure 13:
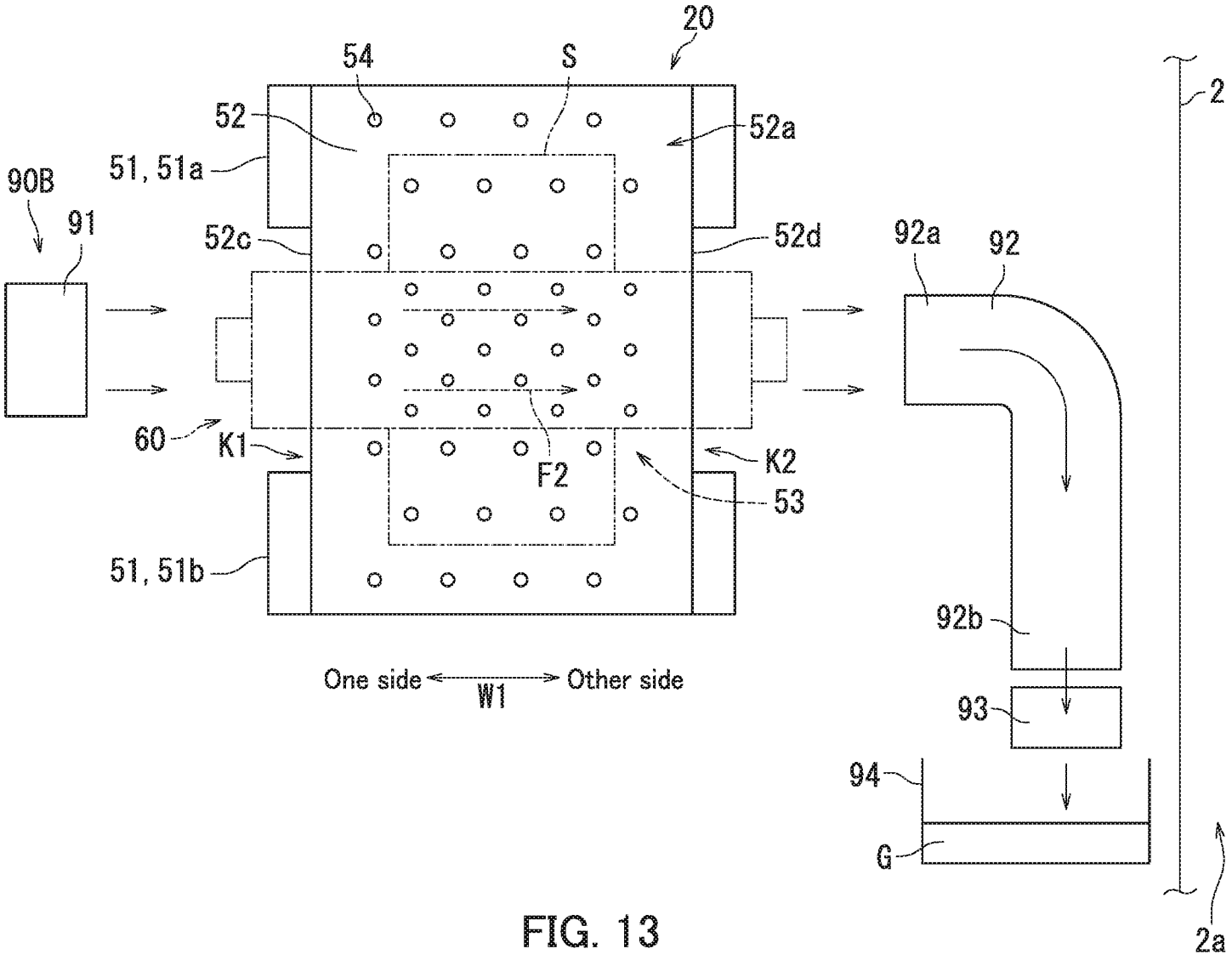
FIG. 13 is a diagram illustrating a decurling device of a sixth embodiment.

Next, an inkjet recording apparatus 1 according to a sixth embodiment of the present disclosure will be described with reference to FIG. 13. FIG. 13 is a diagram illustrating a decurling device 20 of the sixth embodiment.

The sixth embodiment differs from the fifth embodiment in that in the sixth embodiment, a mechanism is provided which condenses ink moisture vapor into water G and houses the water G In the following, points of difference between the fifth and sixth embodiments will be mainly described.

As illustrated in FIG. 13, the decurling device 20 further includes a discharging mechanism 90B. The discharging mechanism 90B condenses the ink moisture vapor that has flowed into a first hollow space 53 into the water G and houses the water G.

The discharging mechanism 90B has a belt air blowing section 91, a pipe 92, a cooling section 93, and a housing section 94.

The pipe 92 connects to an outlet K2 and to the cooling section 93. Specifically, a first opening 92*a* of the pipe 92 connects to the outlet K2 and a second opening 92*b* of the pipe 92 connects to the cooling section 93.

The pipe 92 connecting to the cooling section 93 indicates that air F2 that has flowed out from the second opening 92*b* can flow into the cooling section 93. Specifically, the cooling section 93 is connected to the second opening 92*b*.

The cooling section 93 cools the vapor to condense the vapor into the water G. The cooling section 93 cools the vapor using refrigerant, for example.

The housing section 94 houses the water G created by the cooling section 93. The housing section 94 is a container, for example. The housing section 94 directly or indirectly connects to the cooling section 93.

Continuing, a principle by which the decurling device 20 of the sixth embodiment accelerates drying of ink attached to a sheet S will be described with reference to FIG. 13.

As illustrated in FIG. 13, while a heat source 70 is generating heat, the moisture of the ink attached to the sheet S is heated with the heat of the heat source 70 and evaporates when a first holding surface 52*a* and a second holding surface 60*a* rotate while holding the sheet S therebetween. The resulting vapor flows into the first hollow space 53 through a plurality of belt through holes 54 (refer to FIG. 8). The belt air blowing section 91 discharges the vapor inside the first hollow space 53 from the outlet K2 and causes the vapor to flow into the pipe 92 through the first opening 92*a* with pressure of the air F2. The belt air blowing section 91 then conveys the vapor through the pipe 92 with the pressure of the air F2. The belt air blowing section 91 then supplies the moisture to the cooling section 93 with the pressure of the air F2. Specifically, the vapor is discharged from the second opening 92*b* and supplied to the cooling section 93. The cooling section 93 then cools the vapor to condense the vapor into the water G. The housing section 94 houses the water G created by the cooling section 93.

As described above with reference to FIG. 13, the pipe 92 connects to the outlet K2 and to the cooling section 93. The housing section 94 also connects to the cooling section 93. Accordingly, the ink moisture vapor discharged from the outlet K2 is supplied to the cooling section 93 through the pipe 92 with the pressure of the air F2. The vapor is then condensed into the water G by the cooling section 93 and discharged to the housing section 94. As a result, the vapor is prevented from accumulating inside of a casing 2 and the drying of the ink attached to the sheet S can be effectively accelerated.

The embodiments of the present disclosure have been described above with reference to the drawings (FIGS. 1 to 13). However, the present disclosure is not limited to the above embodiments and can be practiced in various ways within a scope not departing from the essence of the present disclosure (for example, (1) to (12)). Various disclosures can be created by appropriately combining elements of configuration disclosed in the above embodiments. For example, some of the elements of configuration indicated in the above embodiments may be omitted. The drawings are schematic illustrations that emphasize the elements of configuration in order to facilitate understanding thereof, and the numbers and the like of the elements of configuration illustrated in the drawings may differ from actual ones thereof in order to facilitate preparation of the drawings. The elements of configuration in the above embodiments are only examples that do not impose any particular limitations and can be altered in various ways to the extent that there is no substantial deviation from the effects of the present disclosure.

(1) According to the first, third, and fourth embodiments, the heat source 70 is disposed at the roller 60 but not at the belt 52. By contrast, according to the second, fifth, and sixth embodiments, the heat source 70 is disposed at the belt 52 but not at the roller 60. However, in the first to sixth embodiments, heat sources 70 may be respectively disposed at the belt 52 and the roller 60. That is, the heat source(s) 70 may be disposed at either or both of the belt 52 and the roller 60. Accordingly, the heat source(s) 70 heats either or both of the belt 52 and the roller 60.

(2) According to the first embodiment, the second holding surface 60*a* has a plurality of through holes 64 but the first holding surface 52*a* does not have a plurality of belt through holes 54. By contrast, according to the second embodiment, the first holding surface 52*a* has a plurality of belt through holes 54 but the second holding surface 60*a* does not have a plurality of through holes 64.

However, according to the first embodiment, the first holding surface 52*a* may have a plurality of belt through holes 54 but the second holding surface 60*a* may have no through holes 64. In this case, ink moisture vapor originating from the sheet S flows into the first hollow space 53 through the belt through holes 54.

Also, according to the second embodiment, the second holding surface 60*a* may have a plurality of through holes 64 but the first holding surface 52*a* may have no belt through holes 54. In this case, ink moisture vapor originating from a sheet S flows into the second hollow space 65 through the through holes 64.

According to the first and second embodiments, the second holding surface 60*a* may have a plurality of through holes 64 and the first holding surface 52*a* may have a plurality of belt through holes 54. In this case, a portion of ink moisture vapor originating from the sheet S flows into the first hollow space 53 through the belt through holes 54. Another portion of the vapor flows into the second hollow space 65 through the through holes 64.

That is, the decurling device 20 has either or both of the belt through holes 54 penetrating the first holding surface 52*a* and the through holes 64 penetrating the second holding surface 60*a*.

(3) According to the first embodiment, heat sources 70 may be respectively disposed at the belt 52 and the roller 60, and the first holding surface 52*a* may have a plurality of belt through holes 54 in addition to the second holding surface 60*a* having a plurality of through holes 64. In this case, a portion of ink moisture vapor originating from the sheet S flows into the first hollow space 53 through the belt through holes 54. Another portion of the vapor flows into the second hollow space 65 through the through holes 64.

(4) According to the third embodiment, the first holding surface 52*a* may have a plurality of belt through holes 54 but the second holding surface 60*a* may have no through holes 64. In this case, the decurling device 20 has a discharging mechanism 90A instead of the discharging mechanism 80A. Also in this case, ink moisture vapor originating from the sheet S flows into the first hollow space 53 through the belt through holes 54. The vapor is then conveyed to a pipe 92 and discharged to the exterior 2*a* of the casing 2 through the pipe 92 with pressure of air F2.

(5) According to the fourth embodiment, the first holding surface 52*a* may have a plurality of belt through holes 54 but the second holding surface 60*a* may have no through holes 64. In this case, the decurling device 20 has a discharging mechanism 90B instead of the discharging mechanism 80B. Also in this case, ink moisture vapor originating from the sheet S flows into a first hollow space 53 through the belt through holes 54. The vapor is then conveyed to a pipe 92 and a cooling section 93 in the stated order with pressure of air F2. The vapor is then condensed into water G by the cooling section 93 and discharged to a housing section 94.

(6) According to the fifth embodiment, the second holding surface 60*a* may have a plurality of through holes 64 but the first holding surface 52*a* may have no belt through holes 54. In this case, the decurling device 20 has a discharging mechanism 80A instead of a discharging mechanism 90A. Also in this case, ink moisture vapor originating from the sheet S flows into a second hollow space 65 through the through holes 64. The vapor is then conveyed to a pipe 82 and discharged to the exterior 2*a* of the casing 2 through the pipe 82 with pressure of air F1.

(7) According to the sixth embodiment, the second holding surface 60*a* may have a plurality of through holes 64 but the first holding surface 52*a* may have no belt through holes 54. In this case, the decurling device 20 has a discharging mechanism 80B instead of the discharging mechanism 90B. Also in this case, ink moisture vapor originating from the sheet S flows into a second hollow space 65 through the through holes 64. The vapor is then conveyed to a pipe 82 and a cooling section 83 in the stated order with pressure of air F1. The vapor is then condensed into water G by the cooling section 83 and discharged to a housing section 84.

(8) According to the third embodiment, the heat source(s) 70 may be disposed at either or both of the belt 52 and the roller 60, and the first holding surface 52*a* may have a plurality of belt through holes 54 in addition to the second holding surface 60*a* having a plurality of through holes 64. In this case, the decurling device 20 has either a discharging mechanism 80A or a discharging mechanism 80B and either a discharging mechanism 90A or a discharging mechanism 90B.

Figure 14:
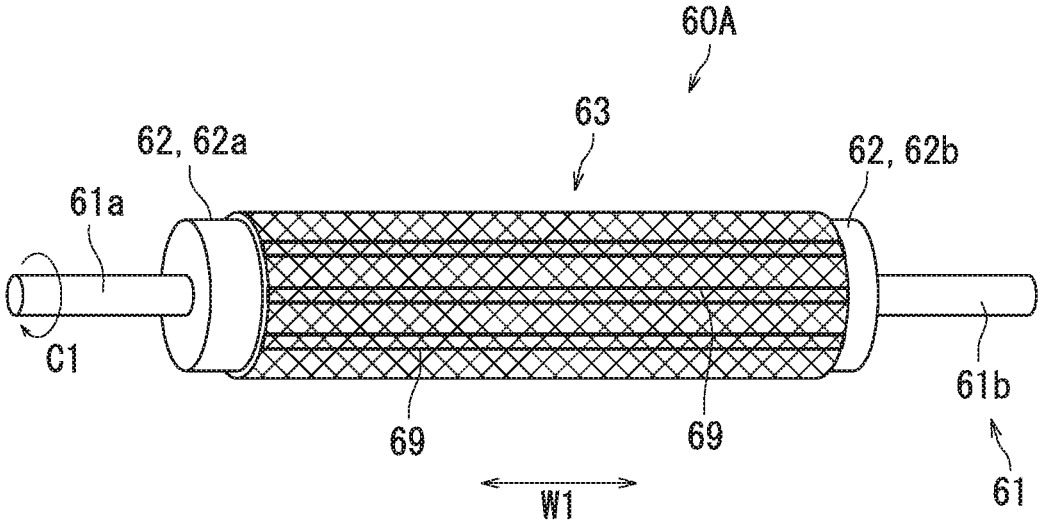
FIG. 14 is a perspective view illustrating a variation of a roller.

(9) A roller 60A will be described with reference to FIG. 14. The roller 60A is a variation of the roller 60. FIG. 14 is a perspective view illustrating the variation of the roller 60 (roller 60A). The roller 60A differs from the roller 60 in that a member supporting a trunk portion 63 is provided between a first flange portion 62*a* and a second flange portion 62*b* in the roller 60A.

The roller 60A has a shaft section 61, the first flange portion 62*a*, the second flange portion 62*b*, and a plurality of rods 69. The first flange portion 62*a* and the second flange portion 62*b* are disposed with a space therebetween in an axial direction W1. Each rod 69 extends in the axial direction W1. The rods 69 are each interposed between the first flange portion 62*a* and the second flange portion 62*b*. The rods 69 are arranged with spaces therebetween in a roller rotational direction C1. One end of each rod 69 is connected to an outer peripheral portion of the first flange portion 62*a*. The other end of each rod 69 is connected to an outer peripheral portion of the second flange portion 62*b*. Each rod 69 is in contact with an inner peripheral surface of the trunk portion 63.

The shaft section 61 includes a first shaft section 61*a* and a second shaft section 61*b*. The first shaft section 61*a* protrudes in the axial direction W1 from the first flange portion 62*a* and protrudes away from the second flange portion 62*b*. The second shaft section 61*b* protrudes in the axial direction W1 from the second flange portion 62*b* and protrudes away from the first flange portion 62*a*.

Note that the first flange portion 62*a* of the roller 60A may have the same configuration as the first flange portion 62*a* of the first embodiment, and the second flange portion 62*b* of the roller 60A may have the same configuration as the second flange portion 62*b* of the first embodiment (refer to FIG. 3A). Also, the first flange portion 62*a* of the roller 60A may have the same configuration as the first flange portion 62*a* of the third embodiment, and the second flange portion 62*b* of the roller 60A may have the same configuration as the second flange portion 62*b* of the third embodiment (refer to FIG. 9A).

As described above with reference to FIG. 14, the roller 60A has a plurality of rods 69. Each rod 69 is connected to the first flange portion 62*a* and the second flange portion 62*b*. That is, the rods 69 each span between the first flange portion 62*a* and the second flange portion 62*b*. The rods 69 are also each in contact with the inner peripheral surface of the trunk portion 63. Accordingly, the rods 69 can support the trunk portion 63.

Figure 15:
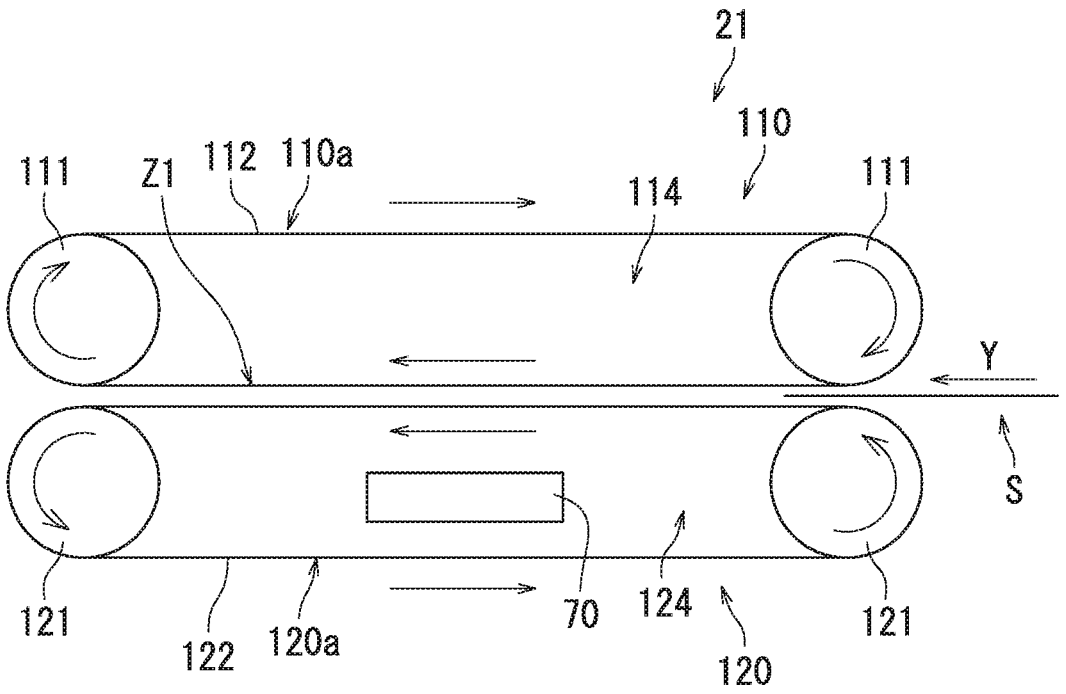
FIG. 15 is a diagram illustrating a variation of a decurling device.

(10) A decurling device 21 will be described with reference to FIG. 15. The decurling device 21 is a variation of the decurling device 20. FIG. 15 is a diagram illustrating the variation of the decurling device 20 (decurling device 21). The decurling device 21 differs from the decurling device 20 in that the decurling device 21 conveys a sheet S with two belts.

The decurling device 21 conveys the sheet S while holding the sheet S in a flat manner.

As illustrated in FIG. 15, the decurling device 21 includes a first belt member 110, a second belt member 120, and a heat source 70.

The first belt member 110 includes a plurality of first support rollers 111 and a first belt 112. The first belt 112 is wound around the first support rollers 111. According to the present embodiment, the first belt 112 is wound around two first support rollers 111. The two first support rollers 111 are disposed with a space therebetween in a conveyance direction Y. The first belt 112 rotates together with the first support rollers 111. Accordingly, the first belt 112 is rotatably supported. The first belt 112 has a first holding surface 110*a*. The first holding surface 110*a* extends in a rotational direction of the first belt 112. The first holding surface 110*a* is on the outside of the first belt 112. A first hollow space 114 is located inside of the first holding surface 110*a*.

The second belt member 120 has a plurality of second support rollers 121, and a second belt (rotating member) 122. The second belt 122 is wound around the second support rollers 121. According to the present embodiment, the second belt 122 is wound around two second support rollers 121. The two second support rollers 121 are disposed with a space therebetween in the conveyance direction Y. The second belt 122 rotates together with the second support rollers 121. Accordingly, the second belt 122 is rotatably supported. The second belt 122 has a second holding surface 120*a*. The second holding surface 120*a* extends in a rotational direction of the second belt 122. The second holding surface 120*a* is on the outside of the second belt 122. A second hollow space 124 is located inside of the second holding surface 120*a*.

The first belt 112 and the second belt 122 rotate while holding the sheet S between the first holding surface 110*a* and the second holding surface 120*a* to convey the sheet S. A nip part Z is formed between the first holding surface 110*a* and the second holding surface 120*a*. The nip part Z1 holds the sheet S. The nip part Z1 is flatly shaped. Accordingly, the first belt 112 and the second belt 122 rotate while holding a portion or all of the sheet S in a flat manner between the first holding surface 110*a* and the second holding surface 120*a* to convey the sheet S.

The heat source 70 heats either or both of the first holding surface 110*a* and the second holding surface 120*a*. The heat source 70 is disposed at either or both of the first belt member 110 and the second belt member 120. Specifically, the heat source 70 is disposed at either or both of the first belt 112 and the second belt 122. The heat source 70 being disposed at the first belt 112 indicates that the heat source 70 is provided within the first belt 112, that the heat source 70 is in direct or indirect contact with the first holding surface 110*a*, or that the heat source 70 is provided within at least one of the first support rollers 111. Also, the heat source 70 being disposed at the second belt 122 indicates that the heat source 70 is provided within the second belt 122, that the heat source 70 is in direct or indirect contact with the second holding surface 120*a*, or that the heat source 70 is provided within at least one of the second support rollers 121. According to the present variation, the heat source 70 is provided within the second belt 122.

The decurling device 21 has either or both of a plurality of first through holes penetrating the first holding surface 110*a* and a plurality of second through holes penetrating the second holding surface 120*a*. The first through holes each provide communication between an exterior of the first belt 112 and the first hollow space 114. The second through holes each provide communication between an exterior of the second belt 122 and the second hollow space 124.

Note that a discharging mechanism 90A (refer to FIG. 12) may be provided for the first belt 112. In this case, a belt air blowing section 91 of the discharging mechanism 90A blows air F2 into the first belt 112. The belt air blowing section 91 blows the air F2 in an axial direction of the first support rollers 111. The axial direction of the first support rollers 111 extends along rotary shafts of the first support rollers 111. The air F2 blown from the belt air blowing section 91 then passes through the first hollow space 114. The air F2 that has passed through the first hollow space 114 flows into a first opening 92*a* of a pipe 92. As a result, the vapor that has flowed into the first hollow space 114 through the first through holes of the first belt 112 can be conveyed and discharged to an exterior 2*a* of a casing 2 with pressure of the air F2.

A discharging mechanism 90B (refer to FIG. 13) may be provided for the first belt 112. In this case, a belt air blowing section 91 of the discharging mechanism 90B blows air F2 into the first belt 112. The belt air blowing section 91 blows the air F2 in the axial direction of the first support rollers 111. The air F2 sent from the belt air blowing section 91 then passes through the first hollow space 114. The air F2 that has passed through the first hollow space 114 flows into a first opening 92*a* of a pipe 92. Accordingly, the vapor that has flowed into the first hollow space 114 through the first through holes of the first belt 112 can be conveyed and supplied to a cooling section 83 with pressure of the air F2. As a result, the vapor can be cooled to condense into water G and the water G can be housed in a housing section 84.

A discharging mechanism 90A (refer to FIG. 12) may be provided for the second belt 122. In this case, a belt air blowing section 91 of the discharging mechanism 90A blows air F2 into the second belt 122. The belt air blowing section 91 blows the air F2 in an axial direction of the second support rollers 121. The axial direction of the second support rollers 121 extends along rotary shafts of the second support rollers 121. The air F2 blown from the belt air blowing section 91 passes through the second hollow space 124. The air F2 that has passed through the second hollow space 124 flows into a first opening 92*a* of a pipe 92. As a result, the vapor that has flowed into the second hollow space 124 through the second through holes of the second belt 122 can be conveyed and discharged to the exterior 2*a* of the casing 2 with pressure of the air F2.

A discharging mechanism 90B (refer to FIG. 13) may be provided for the second belt 122. In this case, a belt air blowing section 91 of the discharging mechanism 90B blows air F2 into the second belt 122. The belt air blowing section 91 blows the air F2 in the axial direction of the second support rollers 121. The air F2 blown from the belt air blowing section 91 then passes through the second hollow space 124. The air F2 that has passed through the second hollow space 124 flows into a first opening 92*a* of a pipe 92. Accordingly, the vapor that has flowed into the second hollow space 124 through the second through holes of the second belt 122 can be conveyed and supplied to a cooling section 83 with pressure of the air F2. As a result, the vapor can be cooled to condense into water G, and the water G can be housed in a housing section 84.

(11) The decurling device 20 and the decurling device 21 may each be provided within a post-processing device. The post-processing device is connected to the inkjet recording apparatus 1. The post-processing device performs predetermined post-processing on a sheet S. The predetermined post-processing is either or both of punching processing and stapling processing, for example. The punching processing forms punch holes in the sheet S. The stapling processing binds sheets S with a binding tool such as a staple.

(12) The sheet S with an ink image formed thereon is conveyed to the decurling device 20 or the decurling device 21. The ink image means an image formed with ink. However, a sheet S with liquid other than ink applied thereto may be conveyed to the decurling device 20 or the decurling device 21. The decurling device 20 and the decurling device 21 each mitigate a curl in the sheet S that has been moistened by the liquid.

What is claimed is:

1. An inkjet recording apparatus comprising:
a decurling device configured to receive a sheet conveyed thereto;
a casing housing the decurling device; and
a first pipe, wherein
the decurling device includes:
a rotatably supported first belt;
a rotatably supported rotating member;
a heat source which heats either or both of the first belt and the rotating member; and
a first air blowing section which blows first air into the first belt,
the first belt has a first holding surface extending in a rotational direction of the first belt,
the rotating member has a second holding surface extending in a rotational direction of the rotating member,
the first belt and the rotating member rotate while holding the sheet between the first holding surface and the second holding surface to convey the sheet,
the decurling device has either or both of a plurality of first through holes penetrating the first holding surface and a plurality of second through holes penetrating the second holding surface,
a first hollow space located inside of the first holding surface,
the first belt has:
a first inlet through which the first air flows in; and
a first outlet through which the first air flows out,
the first inlet and the first outlet each connect to the first hollow space, and
the first pipe connects to the first outlet and to an exterior of the casing.

2. The inkjet recording apparatus according to claim 1, wherein
the rotating member includes a second belt.

3. The inkjet recording apparatus according to claim 1, wherein
the rotating member includes a roller.

4. The inkjet recording apparatus according to claim 3, wherein
the second holding surface faces an image formation surface of the sheet when the first belt and the roller hold the sheet between the first holding surface and the second holding surface, and
the image formation surface is a surface of the sheet on which an image is formed.

5. The inkjet recording apparatus according to claim 4, wherein
the second holding surface is mesh-shaped.

6. The inkjet recording apparatus according to claim 1, wherein
the decurling device further includes a second air blowing section configured to blow second air into the rotating member,
a second hollow space is located inside of the second holding surface,
the rotating member has:
a second inlet through which the second air flows in; and
a second outlet through which the second air flows out, and
the second inlet and the second outlet each connect to the second hollow space.

7. An inkjet recording apparatus, comprising:
a decurling device configured to receive a sheet conveyed thereto;

a casing housing the decurling device; and a second pipe, wherein the decurling device includes:

a rotatably supported first belt;

a rotatably supported rotating member;

a heat source which heats either or both of the first belt and the rotating member; and a first air blowing section which blows first air into the first belt, the first belt has a first holding surface extending in a rotational direction of the first belt, the rotating member has a second holding surface extending in a rotational direction of the rotating member, the first belt and the rotating member rotate while holding the sheet between the first holding surface and the second holding surface to convey the sheet, the decurling device has either or both of a plurality of first through holes penetrating the first holding surface and a plurality of second through holes penetrating the second holding surface, a first open space is located inside of the second holding surface, the rotating member has:

a first inlet through which the first air flows in; and a first outlet through which the first air flows out, the first inlet and the first outlet each connect to the first hollow space, and the second pipe connects to the first outlet and to an exterior of the casing.

8. The inkjet recording apparatus according to claim 7, wherein the rotating member includes a second belt.

9. The inkjet recording apparatus according to claim 7, wherein the rotating member includes a roller.

10. The inkjet recording apparatus according to claim 9, wherein the second holding surface faces an image formation surface of the sheet when the first belt and the roller hold the sheet between the first holding surface and the second holding surface, and the image formation surface is a surface of the sheet on which an image is formed.

11. The inkjet recording apparatus according to claim 10, wherein the second holding surface is mesh-shaped.

12. The inkjet recording apparatus according to claim 7, wherein the decurling device further includes a second air blowing section configured to blow second air into the first belt, a second hollow space is located inside of the first holding surface, the first belt has:

a second inlet through which the second air flows in; and a second outlet through which the second air flows out, and the second inlet and the second outlet each connect to the second hollow space.

* * * * *